US010941629B2

(12) United States Patent
Yousef et al.

(10) Patent No.: US 10,941,629 B2
(45) Date of Patent: Mar. 9, 2021

(54) ROTATING CONTROL DEVICE HAVING A LOCKING BLOCK SYSTEM

(71) Applicant: Nabors Drilling Technologies USA, Inc., Houston, TX (US)

(72) Inventors: Faisal Yousef, Houston, TX (US); Tommy Vu, Houston, TX (US); Brian Ellis, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 22 days.

(21) Appl. No.: 16/054,974

(22) Filed: Aug. 3, 2018

(65) Prior Publication Data

US 2020/0040689 A1 Feb. 6, 2020

(51) Int. Cl.

| | |
|---|---|
| ***E21B 4/00*** | (2006.01) |
| ***E21B 23/02*** | (2006.01) |
| ***E21B 33/06*** | (2006.01) |
| ***E21B 33/08*** | (2006.01) |
| *E21B 21/10* | (2006.01) |
| *E21B 34/16* | (2006.01) |

(52) U.S. Cl.

CPC ..... *E21B 33/085* (2013.01); *E21B 4/003* (2013.01); *E21B 23/02* (2013.01); *E21B 33/061* (2013.01); *E21B 21/106* (2013.01); *E21B 34/16* (2013.01)

(58) Field of Classification Search

CPC ..... E21B 4/003; E21B 23/02; E21B 33/061; E21B 33/085

See application file for complete search history.

(56) References Cited

U.S. PATENT DOCUMENTS

| | | | | |
|---|---|---|---|---|
| 3,621,912 | A * | 11/1971 | Wooddy, Jr. ..... | E21B 33/085 166/340 |
| 4,363,357 | A * | 12/1982 | Hunter ..... | E21B 33/085 166/84.3 |
| 7,165,610 | B2 * | 1/2007 | Hopper ..... | E21B 33/085 166/84.1 |
| 7,174,956 | B2 | 2/2007 | Williams et al. | |
| 7,198,098 | B2 | 4/2007 | Williams | |
| 7,334,633 | B2 | 2/2008 | Williams et al. | |
| 7,726,416 | B2 * | 6/2010 | Williams ..... | E21B 33/085 175/195 |

(Continued)

*Primary Examiner* — Matthew R Buck

(57) ABSTRACT

A system for locking a bearing assembly to a rotating control device (RCD) housing is provided. The RCD housing can be coupled to a blowout preventer, and the bearing assembly can be received within the housing, and can comprise a stationary bearing housing having a perimeter channel. A plurality of locking block assemblies are each supported by the housing and are operable between a locked position and an unlocked position. Each locking block assembly comprises a movable block configured to interface with the perimeter channel when in the locked position, and at least one elastic component is situated between the housing and the movable block. The at least one elastic component is configured to automatically bias the movable block in the locked position. Upon supplying fluid pressure via a valve device, the movable block moves to the unlocked position and the at least one elastic component compresses to facilitate removal of the bearing assembly from the RCD housing. Associated systems and methods are provided.

27 Claims, 16 Drawing Sheets

(56) References Cited

U.S. PATENT DOCUMENTS

| | | | | |
|---|---|---|---|---|
| 7,766,100 | B2 * | 8/2010 | Williams | E21B 33/085 166/85.5 |
| 7,798,210 | B1 * | 9/2010 | Pruitt | E21B 33/085 166/84.1 |
| 7,874,353 | B2 | 1/2011 | Williams | |
| 8,256,507 | B2 | 9/2012 | Williams | |
| 8,322,432 | B2 * | 12/2012 | Bailey | E21B 33/085 166/344 |
| 8,991,484 | B2 * | 3/2015 | Riggs | F16L 23/10 166/84.1 |
| 9,057,239 | B2 * | 6/2015 | Young | E21B 33/038 |
| 9,068,433 | B2 * | 6/2015 | Bushman | E21B 41/0007 |
| 9,856,713 | B2 * | 1/2018 | Tarique | E21B 33/085 |
| 2012/0013133 | A1 * | 1/2012 | Rios, III | E21B 23/01 292/159 |
| 2014/0238686 | A1 * | 8/2014 | Boyd | E21B 17/01 166/367 |
| 2016/0123399 | A1 * | 5/2016 | Arnt | E21B 33/085 384/559 |
| 2016/0258239 | A1 * | 9/2016 | Clark | E21B 33/085 |
| 2016/0305213 | A1 * | 10/2016 | Godfrey | E21B 33/085 |
| 2019/0093445 | A1 * | 3/2019 | Kulkarni | E21B 33/085 |

* cited by examiner

ROTATING CONTROL DEVICE HAVING A LOCKING BLOCK SYSTEM

BACKGROUND

During drilling operations, drilling mud may be pumped into a wellbore. The drilling mud may serve several purposes, including applying a pressure on the formation, which may reduce or prevent formation fluids from entering the wellbore during drilling. The formation fluids mixed with the drilling fluid can reach the surface, resulting in a risk of fire or explosion if hydrocarbons (liquid or gas) are contained in the formation fluid. To control this risk, pressure control devices are installed at the surface of a drilling, such as one or more blowout preventers (BOPs) that can be attached onto a wellhead above the wellbore. A rotating control device (RCD) is typically attached on the top of the BOPs to divert mud/fluid to, and circulate it through, a choke manifold to avoid the influx of fluid reaching a drilling rig floor (as well as allowing pressure management inside the wellbore). The RCD includes a bearing assembly used for purposes of controlling the pressure of fluid flow to the surface while drilling operations are conducted. The bearing assembly is typically raised by a top drive assembly and then inserted into a "bowl" of the RCD. The bearing assembly rotatably receives and seals a drill pipe during drilling operations through the wellhead. Thus, the bearing assembly acts as a seal and a bearing, as supported by the RCD.

After the bearing assembly is inserted into the bowl of the RCD, the RCD can be operated to "lock" a stationary housing of the bearing assembly to the RCD (while still allowing for the rotational components of the bearing assembly to rotate along with a rotating drill pipe). This "locking" function is typically performed with ram mechanisms coupled to the RCD housing and that are actuated to lock the bearing assembly to the RCD housing, and then actuated to unlock the bearing assembly from the RCD housing (such as when seals of the bearing assembly need to be replaced). Another type of locking mechanisms includes a clamp mechanism that is manually or hydraulically actuated to lock the bearing assembly to the RCD housing. Both the ram mechanisms and the clamp mechanism have various drawbacks. More specifically, the ram mechanism must have internal machine threads and a threaded rod, and a motor to rotate the threaded rod. The rod drives the ram into the bearing assembly to lock it. This is disadvantageous because the ram mechanism must be locked manually by an operator, which is dangerous and time consuming. The clamp mechanism is disadvantageous because it must be manually operated by an individual operator to lock the bearing assembly to the RCD housing, which is dangerous and time consuming.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
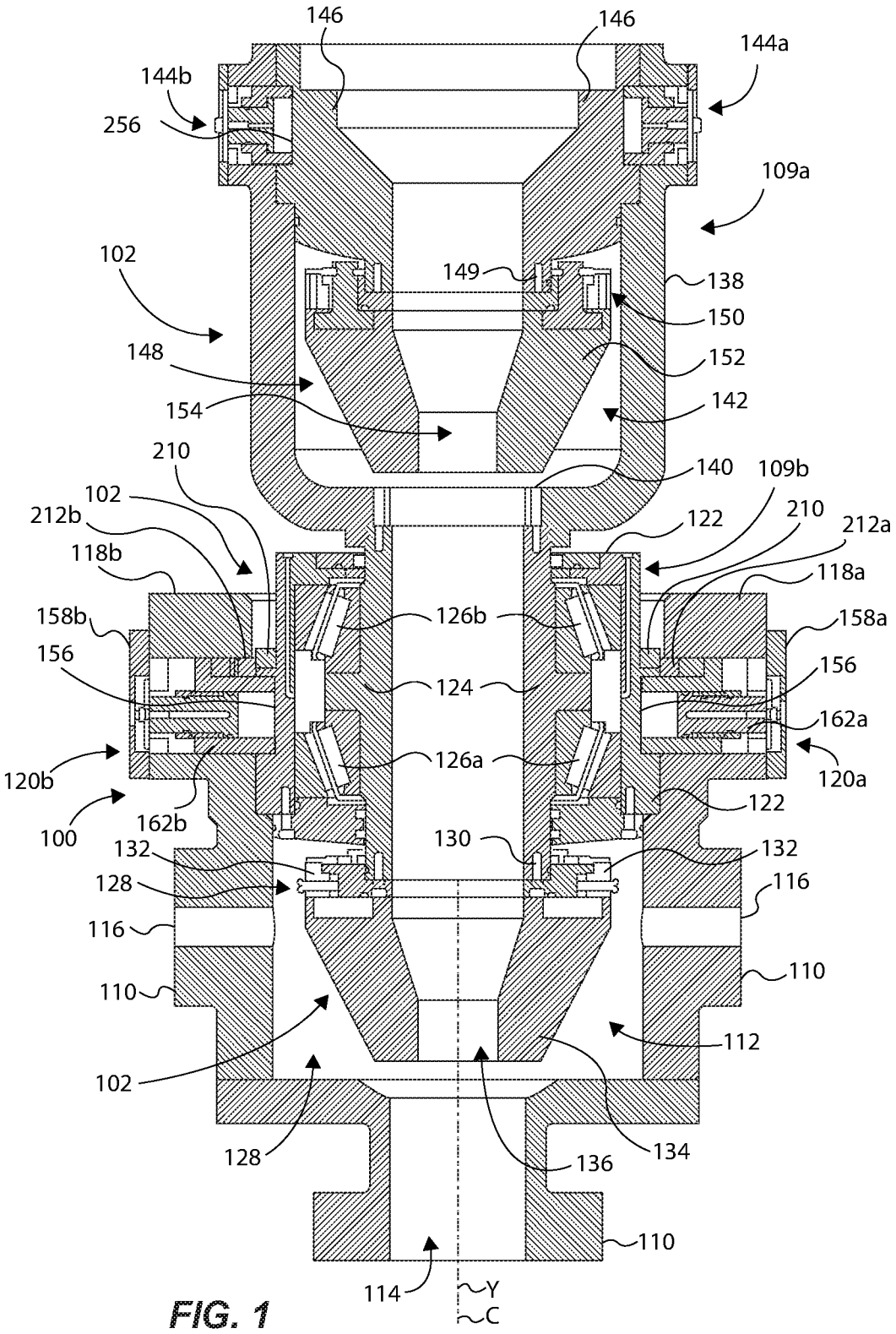
FIG. 1 is a cross-sectional view of an RCD having a bearing assembly and a locking block system in accordance with an example of the present disclosure, and as taken along lines 1-1 in FIG. 2.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present disclosure sets forth a rotating control device (RCD) for use on a drill rig, and particularly a locking block system of an RCD. The RCD comprises a housing (often referred to as or defining a bowl) operable with a blowout preventer, and a bearing assembly operable to be received in the housing, and operable to receive a pipe of a drill string. The locking block system of the RCD comprises a plurality of locking block assemblies supported by the housing. Each locking block assembly comprises a movable block movable between an unlocked position that unlocks the bearing assembly from the housing, and a locked position that automatically locks the bearing assembly to the housing.

In one example, each locking block assembly comprises: the movable block configured to interface with a perimeter channel of a stationary bearing housing of the bearing assembly when in the locked position; at least one elastic component situated between the housing and the movable block, and configured to automatically bias the movable block in the locked position; and a valve device coupled to the housing and movably interfaced with the movable block, wherein, upon supplying hydraulic fluid pressure via the valve device, the movable block moves to the unlocked position and the at least one elastic component compresses. And, upon removing hydraulic fluid pressure via the valve device, the at least one elastic component expands to automatically lock the movable block to the perimeter channel of the stationary bearing housing.

The present disclosure sets forth an RCD for use on a drill rig. The RCD comprises an RCD housing coupled to a blowout preventer; a bearing assembly received within the RCD housing and comprising a stationary bearing housing having a perimeter channel; and a plurality of locking block assemblies supported by the RCD housing. Each locking block assembly comprises a movable block automatically biased in a locked position to engage the perimeter channel of the stationary bearing housing to lock the bearing assembly to the RCD housing.

In one example, when the locking block assembly transitions from an unlocked position to the locked position, at least one elastic components bias the respective movable blocks toward the bearing assembly to facilitate lateral self-alignment of the bearing assembly relative to the RCD housing.

The present disclosure sets forth a locking block system for facilitating replacement of one or more sealing elements associated with an RCD. The system comprises an RCD comprising a RCD housing coupled to a blowout preventer, and a bearing assembly received within the RCD housing and configured to receive a pipe of a drill string of the oil rig. The bearing assembly comprises: a stationary bearing housing; a lower sealing element coupled to the stationary bearing housing, the lower sealing element sealingly engaged (i.e., engaged in a manner, such that a seal is formed) with the pipe; a upper sealing element housing coupled to an upper sealing element sleeve; an upper sealing element coupled to the upper sealing element sleeve, and the upper sealing element is sealingly engaged with the pipe. The system comprises a plurality of lower locking block assemblies supported by the RCD housing and operable between a locked position and an unlocked position, wherein, when in the locked position, the plurality of lower locking block assemblies lock the stationary bearing housing to the RCD housing, and, when in the unlocked position, the locking block assemblies unlock the stationary bearing housing from the RCD housing to facilitate replacement of the lower sealing element. The system further comprises a plurality of upper locking block assemblies supported by the upper sealing element housing and operable between a locked position and an unlocked position, wherein, when in the locked position, the plurality of upper locking block assemblies lock the upper sealing element sleeve to the upper sealing element housing, and, when in the unlocked position, the plurality of upper locking block assemblies unlock the upper sealing element sleeve from the upper sealing element housing to facilitate replacement of the upper sealing element.

The present disclosure sets forth a method for operating a locking block system of an RCD of a drill rig comprising identifying an RCD coupled to a blowout preventer of a drill rig. The RCD comprises an RCD housing operable with the blowout preventer and is configured to receive a bearing assembly that receives a pipe of a drill string. The RCD comprises a bearing assembly receivable into the RCD housing. The bearing assembly is operable to receive a pipe of a drill string of a drill rig. The RCD comprises a plurality of locking block assemblies supported by the RCD housing, where each locking block assembly has a movable block and at least one elastic component. The method comprises applying an actuation force to the movable blocks of the plurality of locking block assemblies to be in an unlocked position, wherein each moveable block is caused to be displaced in a direction so as to compress the respective at least one elastic component. The method comprises selectively maintaining the movable blocks in the unlocked position by maintaining application of the actuation force on the moveable blocks, and then inserting the bearing assembly into the RCD housing. The method comprises removing the actuation force, whereby the movable blocks transition from the unlocked position to a locked position, such that the moveable blocks interface with and engage the bearing assembly.

In one example, removing the actuation force comprises removing fluid pressure from the movable blocks via a valve device to allow the respective at least one elastic components to cause the respective movable blocks to automatically move to the locked position.

In one example, selectively maintaining the movable blocks in an unlocked position comprises supplying fluid pressure to each movable blocks via the respective valve devices.

To further describe the present technology, examples are now provided with reference to the figures.

Figure 2:
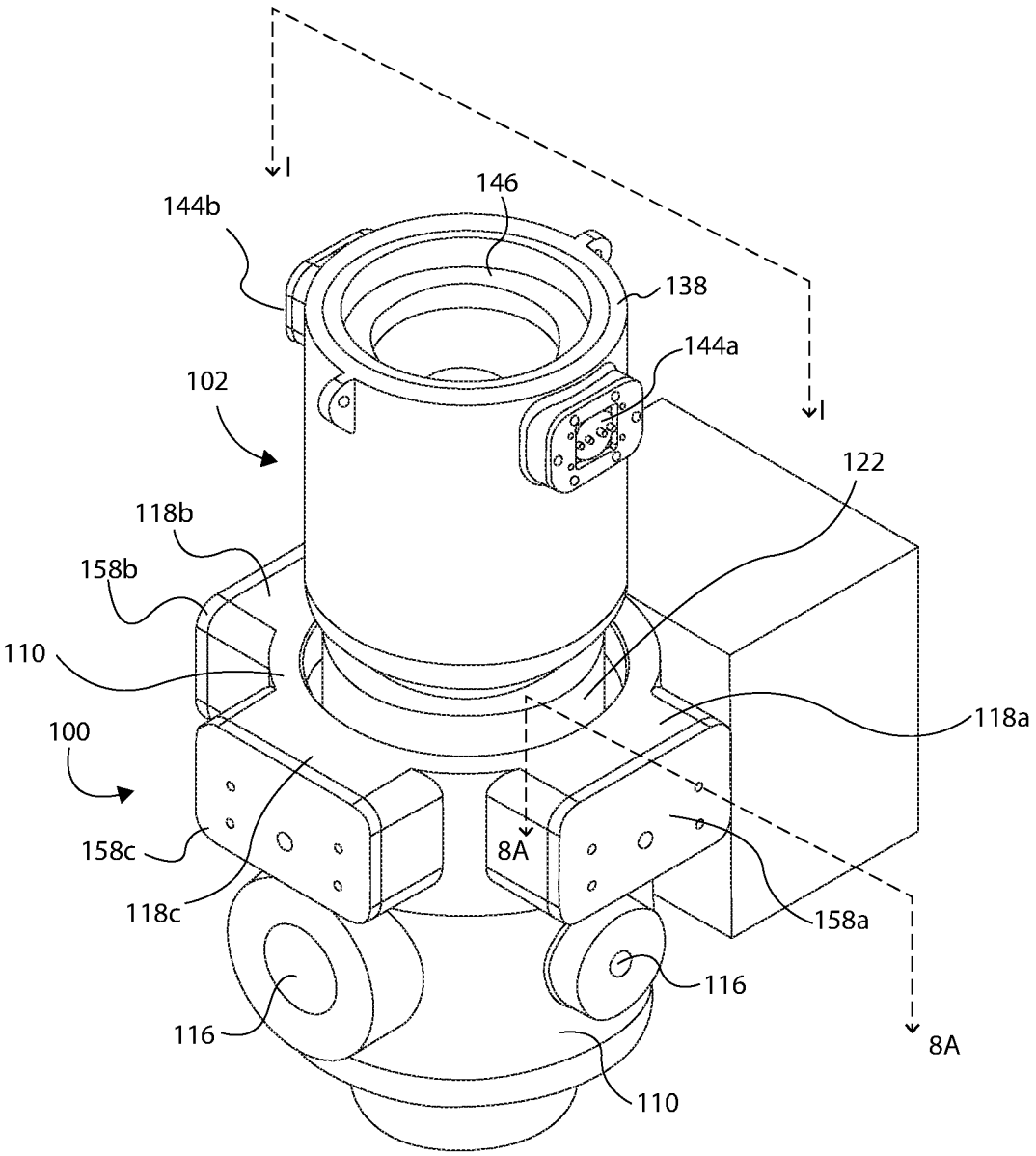
FIG. 2 is an isometric view of the RCD of FIG. 1.
Figure 3:
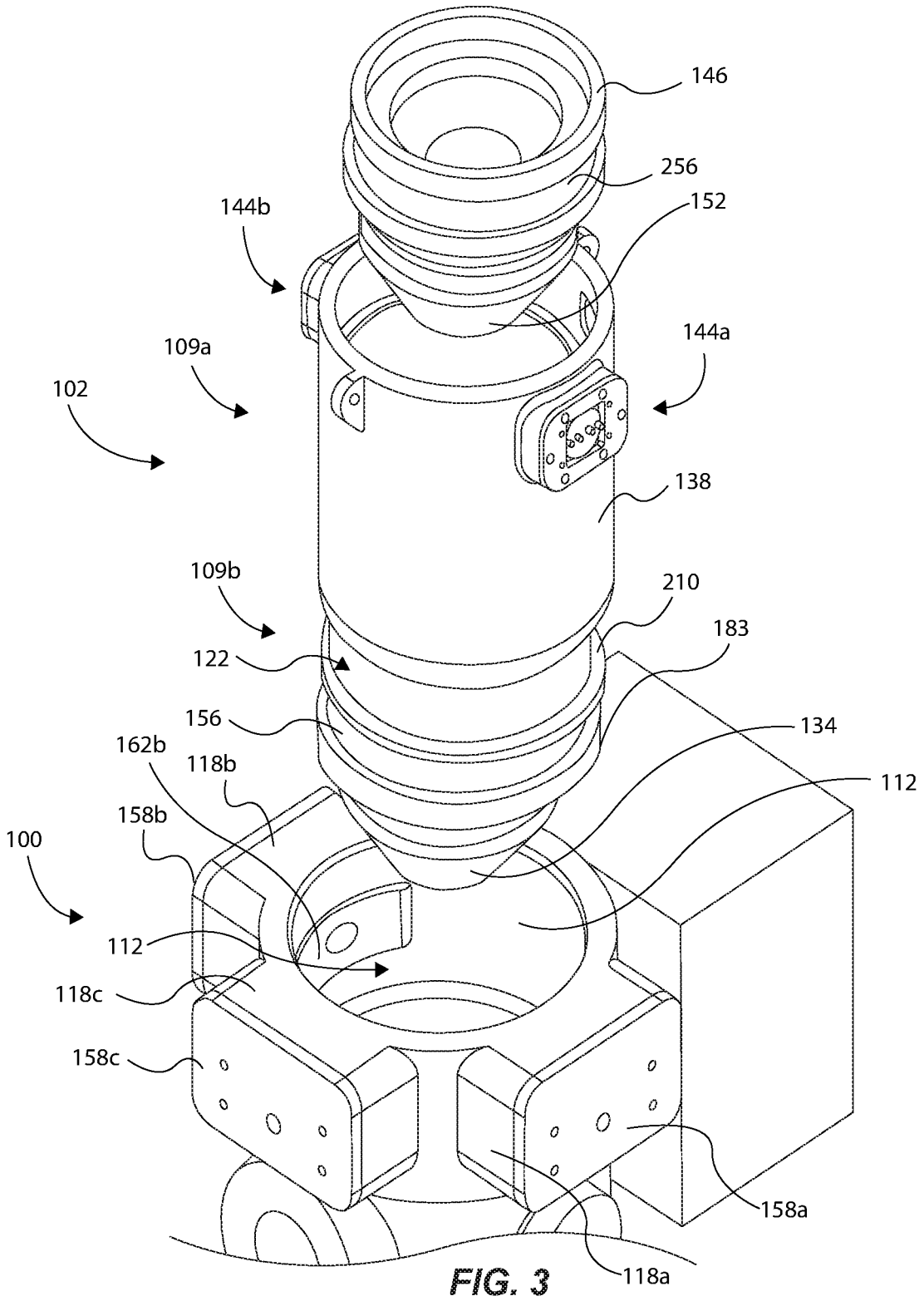
FIG. 3 is an exploded isometric view of the RCD of FIG. 1.
Figure 4:
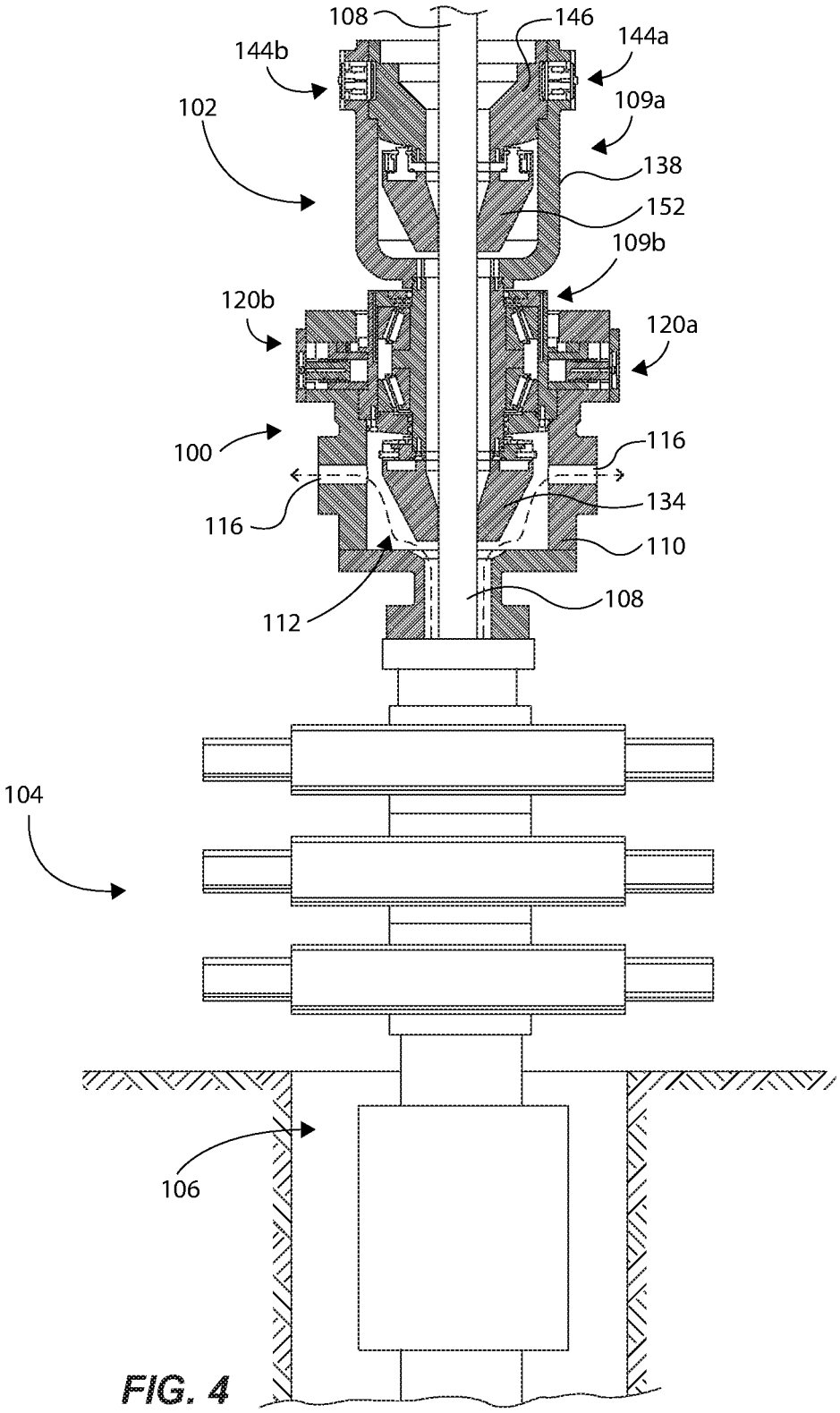
FIG. 4 is a cross-sectional view of the RCD of FIG. 1, taken along lines 1-1 in FIG. 2, with the RCD shown as being coupled to BOPs about a wellbore.

FIGS. 1-4 are illustrated as follows: FIG. 1 shows a cross-sectional view of a rotating control device (RCD) 100 having a bearing assembly 102; FIG. 2 shows an isometric view of the RCD 100 and its bearing assembly 102; FIG. 3 shows a partially exploded view of the RCD 100 and its bearing assembly 102; and FIG. 4 shows a cross-sectional view of the RCD 100 (and its bearing assembly 102) coupled to BOPs 104 above a wellbore 106. As illustrated in FIG. 4, the RCD 100 is attached on the top of and operable with the stack of BOPs 104 to divert mud/fluid away from a rig floor. The bearing assembly 102 can be used for purposes of controlling the pressure of fluid flow to the surface while drilling operations are conducted. The bearing assembly 102 can be operable with and raised by a top drive assembly (not shown) (or other means) and then inserted into an RCD housing 110 of the RCD 100 in a manner, such that the bearing assembly 102 receives and seals a drill pipe 108 during drilling operations. Thus, the bearing assembly 102 acts as a seal and a bearing, as supported by the RCD housing 110, during drilling operations.

With reference to FIGS. 1-4, the bearing assembly 102 of the RCD 100 comprises an upper sealing assembly 109*a* and a lower bearing assembly 109*b* coupled or otherwise secured to or associated with each other. The RCD housing 110 is configured to be coupled to the top of the BOPs 104 (see FIG. 4). The housing 110 comprises a bowl area 112 sized to receive the lower bearing assembly 109*b* of the bearing assembly 102. The housing 110 comprises a lower opening 114 through which the drill pipe 108 (FIG. 4) loosely passes through to the BOPs 104. The housing 110 further comprises a plurality of openings 116 through which mud/fluid can be diverted to other systems during drilling operations.

Figure 7A:
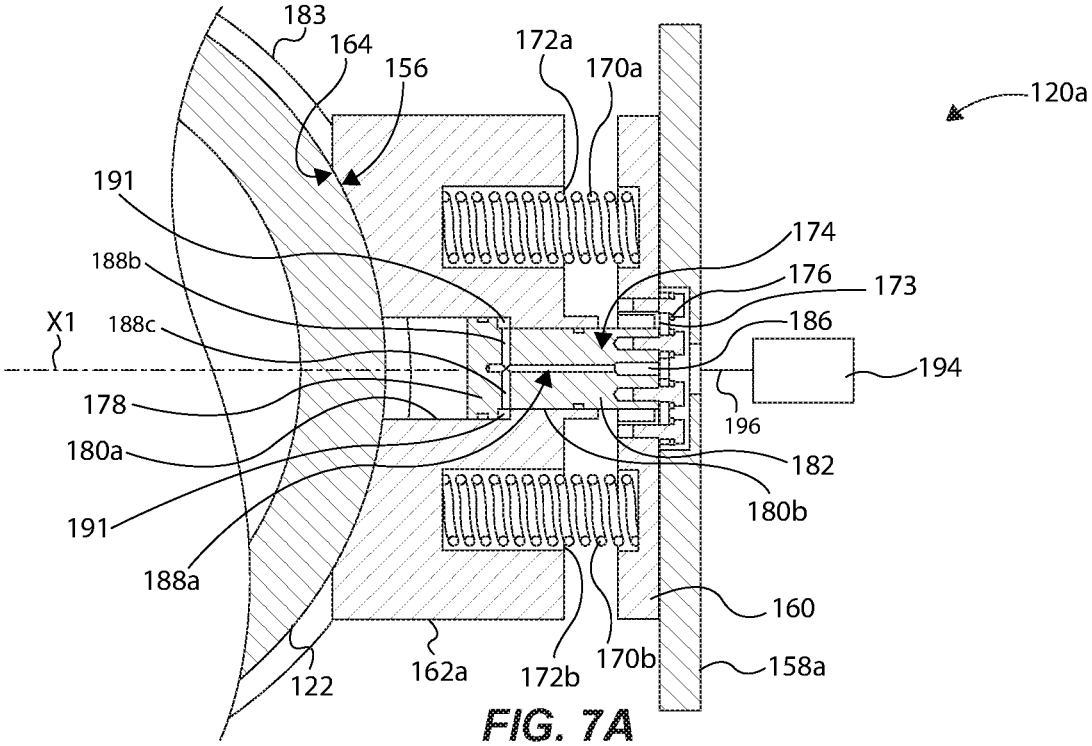
FIG. 7A is a partial cross-sectional view of the bearing assembly of FIG. 1 taken along lines 7A-7A of FIG. 5, illustrating the locking block assembly in a locked position.
Figure 7B:
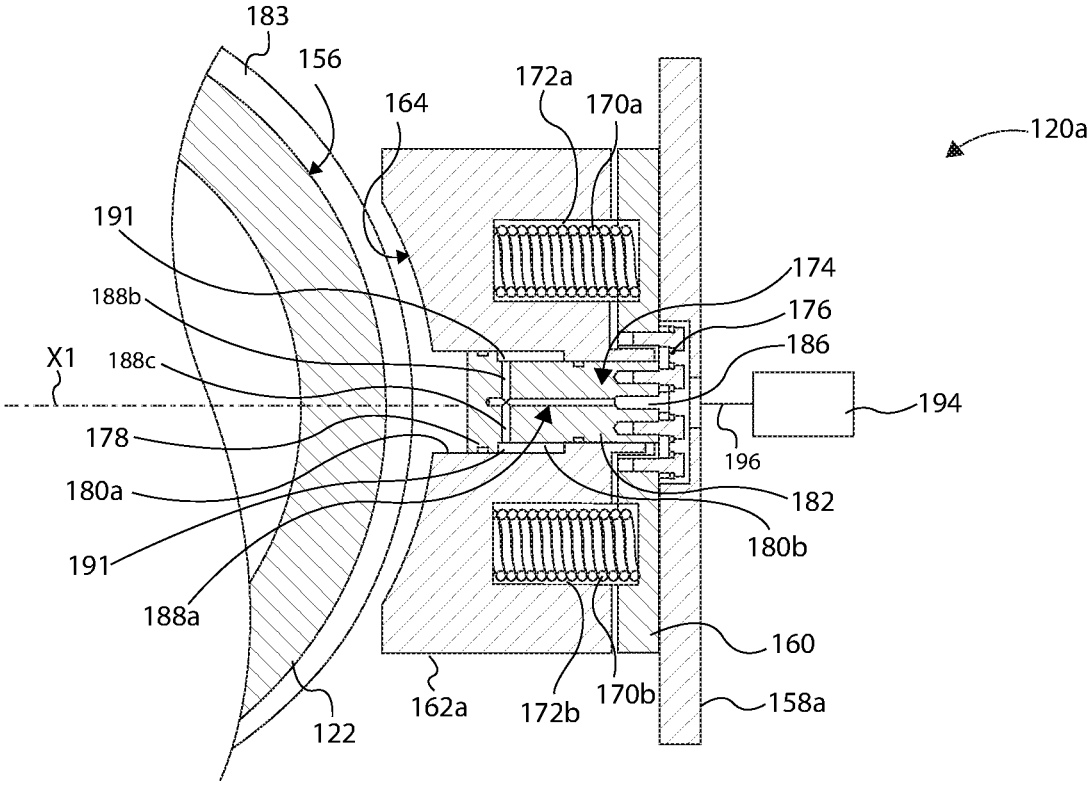
FIG. 7B is a partial cross-sectional view of the bearing assembly of FIG. 1, taken along lines 7A-7A of FIG. 5, illustrating the locking block assembly in an unlocked position.

The housing 110 can comprise sub-housings 118*a-c* that each support respective lower locking block assemblies as part of a locking block system for the RCD 100 (see lower locking block assemblies 120*a*, 120*b* in FIG. 1, with the sub housing 118*a-c* also comprising a similar lower locking block assembly, even though not specifically shown) that are each coupled to and supported by the housing 110. The three locking block assemblies shown are arranged annularly relative to one another, and provide three points of contact on the bearing assembly 102. As will be detailed below, the locking block system, and particularly each locking block assembly 120*a-c*, is operable between a locked position (e.g., FIG. 7A) that locks the bearing assembly 102 to the housing 110, and an unlocked position (e.g., FIG. 7B) that unlocks the bearing assembly 102 from the housing 110. One primary purpose of unlocking (and removing) the bearing assembly 102 from the housing 110 is to replace sealing elements of the bearing assembly 102 between downhole drilling operations, as detailed below.

The bearing assembly 102 can comprise a stationary bearing housing 122 that rotatably supports a lower sealing element sleeve 124 via upper and lower bearing assemblies 126*a* and 126*b* (FIG. 1). The upper and lower bearing assemblies 126*a* and 126*b* can be situated between the lower sealing element sleeve 124 and the stationary bearing housing 122 to rotatably support the lower sealing element sleeve 124 about the stationary bearing housing 122. In one example, as shown, the bearing assemblies 126*a* and 126*b* can comprise tapered bearings (tapered bearings are well known and will not be discussed in great detail). It is noted that those skilled in the art will recognize that other types of bearing assemblies could be used, and incorporated between the stationary bearing housing 122 and the lower sealing element sleeve 124. As such, the tapered bearings shown are not intended to be limiting in any way.

A lower sealing assembly 128 can be attached to a lower end of the rotary casing 124 via fasteners 130. The lower sealing assembly 128 can comprise a lower plate lock device 132 and a lower sealing element 134 (e.g., rubber stripper/packer) removably coupled to the lower plate lock device 132. One example configuration of the lower sealing assembly 128 is further described in U.S. patent application Ser. No. 16/054,969, filed Aug. 3, 2018, which is incorporated by reference herein in its entirety. Those skilled in the art will recognize other ways for coupling the lower sealing element 134 to or about the bearing assembly 102.

The lower sealing element 134 can comprise an opening 136 sized to receive a pipe 108 (FIG. 4), wherein the lower sealing element 134 interfaces with and seals against the pipe 108 to function as a seal as the pipe 108 rotates with the lower sealing element 134, which seal prevents mud/debris from entering the bearing assembly 102 and facilitates routing of the mud/debris out the side openings 116. Thus, as the pipe 108 rotates during drilling operations, the lower sealing element 134 concurrently rotates, thereby rotating the lower sealing element sleeve 124 (as rotatably supported by the tapered bearing assemblies 126*a* and 126*b*).

In one example, as shown, the upper sealing assembly 109*a* can comprise a upper sealing element housing 138 coupled to an upper end of the lower sealing element sleeve 124 via fasteners 140. Note that the upper sealing assembly 109*a* is an optional assembly that can be coupled to the lower bearing assembly 109*b*; however, only the lower bearing assembly 109*b* may be utilized in some applications as desired. The upper sealing element housing 138 defines a bowl area 142, and supports a plurality of upper locking block assemblies 144*a* and 144*b* operable to lock and unlock an upper sealing element sleeve 146, via a perimeter channel 256 of the upper sealing element sleeve 146, from the upper sealing element housing 138, as further detailed below. An upper sealing assembly 148 can be coupled to a lower end of the upper sealing element sleeve 146 via fasteners 149. The upper sealing assembly 148 can comprise an upper plate lock device 150 and an upper sealing element 152 (e.g., a rubber stripper/packer) removably coupled to the upper plate lock device 150. The configuration of the upper sealing assembly 148 is further described in U.S. patent application Ser. No. 16/054,969, filed Aug. 3, 2018, which is incorporated by reference herein in its entirety. The upper sealing element 152 can comprise an opening 154 sized and configured to receive the pipe 108, wherein the upper sealing element 152 tightly grips and seals against the pipe 108 (FIGS. 1 and 3) to act as a seal as the pipe 108 rotates along with the upper sealing element 152. Thus, as the pipe 108 rotates during drilling operations, and as the lower sealing element 134 and the lower sealing element sleeve 124 rotate, the entire upper sealing assembly 109*a* rotates (including the upper sealing element housing 146 and the upper sealing element 152). Thus, the bearing assemblies 126*a* and 126*b* also rotatably support the upper sealing assembly 109*a* via the lower sealing element sleeve 124. As can be appreciated, only the upper and lower sealing elements 152 and 134 are in contact with portions of the pipe 108 as it extends through the respective openings 136 and 154, and as the pipe 108 rotates during drilling.

When the upper and lower sealing elements 152 and 134 wear down and need to be replaced (e.g., sometimes daily), the bearing assembly 102 can be removed from the RCD housing 110 when the lower locking block assemblies (e.g., lower locking block assemblies 120*a-c*) are in the unlocked position (discussed below). Once the bearing assembly 102 is removed, the lower sealing element 134 can be removed (via the lower plate lock device 128) and replaced with a new sealing element. Similarly, the upper sealing element sleeve 146 (and the attached upper sealing element 152) can be removed from the upper sealing element housing 138 upon moving the upper locking block assemblies 144*a* and 144*b* to the unlocked position, and the upper sealing element 152 replaced with a new sealing element.

With reference to FIGS. 5-7B, and continued reference to FIGS. 1-4, the configuration and operation of the lower locking block assemblies 120*a-c* (and the upper locking block assemblies 144*a* and 144*b*) is discussed below in further detail. Each lower locking block assembly 120*a-c* is operable between the locked position (FIGS. 1, 5, and 7A) that locks the bearing assembly 102 to the housing 110, and an unlocked position (FIG. 7B) that unlocks the bearing assembly 102 from the housing 110 so that it can be removed for any given purpose.

Figure 5:
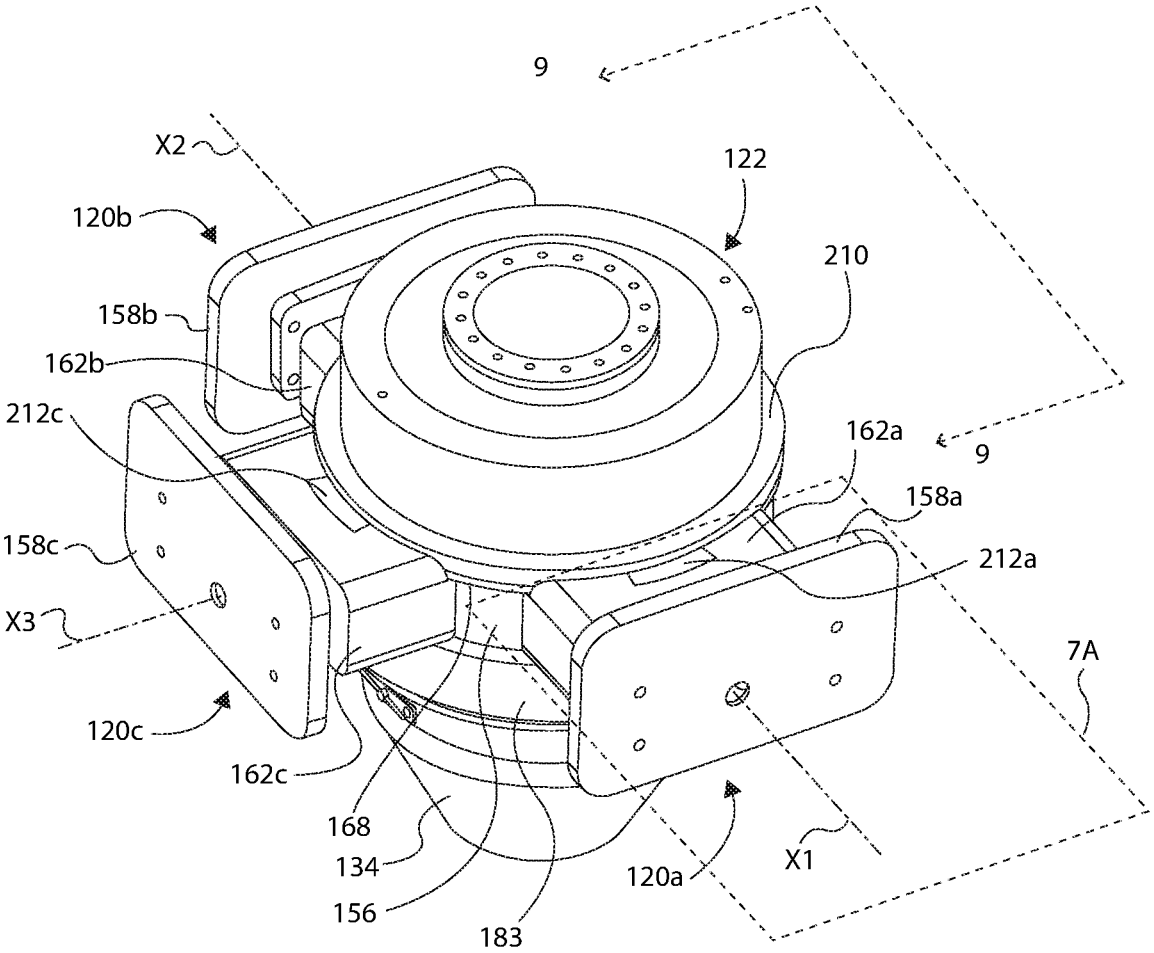
FIG. 5 is an isometric view of a portion of the locking block system of the RCD and a portion of the bearing assembly of FIG. 1, FIG. 5 further illustrating an anti-rotation locking system in accordance with one example.

More specifically, and in one example, the stationary bearing housing 122 can comprises a perimeter or circumferential groove or channel 156 formed as an annular recess around the generally cylindrically-shaped stationary bearing housing 122 (see e.g., FIGS. 1, 3 and 5). The perimeter channel 156 can be defined, at least in part, by an upper annular flange member 168, and a shoulder portion 183, each extending outwardly from the perimeter channel 156. Note that FIG. 5 only shows the lower bearing assembly 109*b* and the lower locking block assemblies 120*a-c* (the upper sealing assembly 109*a* and the housing 110 are omitted for illustration clarity, to show the lower locking block assemblies 120*a-c* locked to the stationary bearing housing 122).

Figure 6:
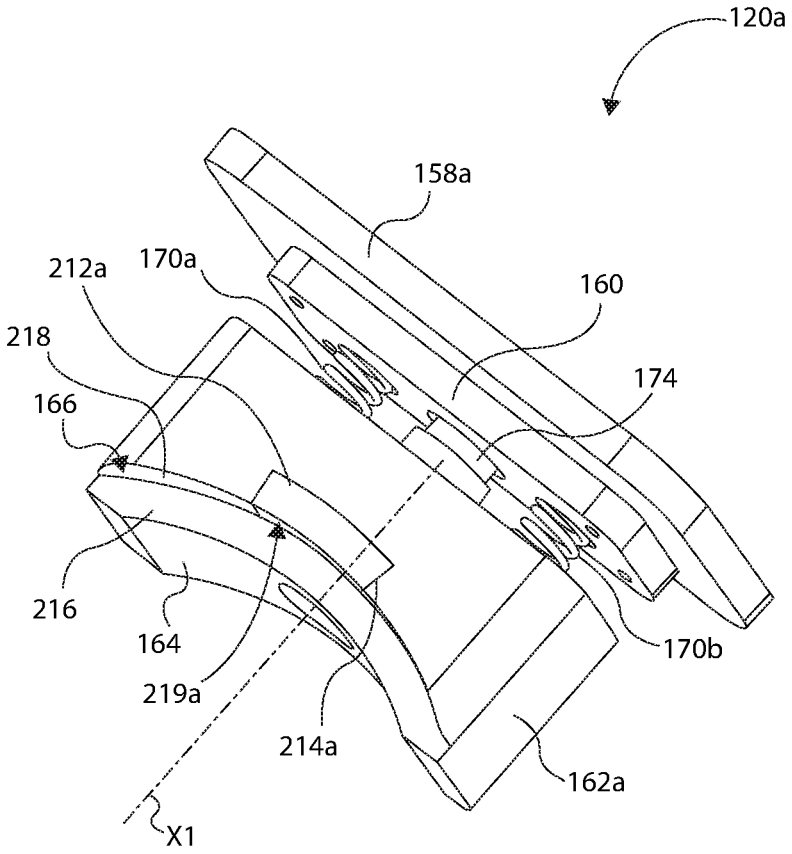
FIG. 6 is an isometric view of a movable block of a locking block assembly of the locking block system of the RCD of FIG. 1.

The lower locking block assemblies 120*a-c* can each comprise a housing support member 158*a-c* removably coupled to respective sub-housings 118*a-c* via fasteners (not shown), for instance (see e.g., FIGS. 1, 5, and 6). The housing support members 158*a-c* are each removable to allow access to the inside of the sub-housings 118*a-c* and the internal mechanisms of the locking block assemblies 120*a-c* for installation and maintenance of the locking block assemblies 120*a-c*.

With continued reference to FIGS. 1-5, and further reference to FIG. 6 (showing one lower locking block assembly 120*a* as an example, with the other locking block assemblies comprising similar configurations and interfaces), the locking block assembly 120*a* comprises a movable block 162*a* configured to interface with the perimeter channel 156 of the stationary bearing housing 122 (see also FIG. 5), as well as an upper annular flange 168 and the shoulder portion 183 of the bearing housing 122. Specifically, the movable block 162*a* comprises a channel interface surface 164 having a radial configuration that corresponds to a radial surface of the perimeter channel 156 when in the locked position (see FIG. 5 and discussion below pertaining to FIG. 7A). The movable block 162*a* can further comprise a shoulder portion 166 that interfaces with and engages the upper annular flange member 168 of the stationary bearing housing 122 (further detailed below), wherein a lower portion of the movable block 162*a* is about the shoulder portion 183. This same arrangement and relationship is provided for with respect to each of the other locking block assemblies 120*a-c*. Thus, when in the locked position, the upper annular flange member 168 is seated about or within each of the shoulder portions (e.g., 166) of each of the respective lower locking block assemblies 120*a-c*, that interface with the stationary bearing housing 122 when in the locked position and during drilling operations. When in the unlocked position, the upper annular flange member 168 becomes unseated from the shoulder portions of the respective lower locking block assemblies 120*a-c*.

The term "block" can mean generally a block or cuboid shaped component, such as one having a rectangular cross-sectional area (along one or more planes). However, this is not intended to be limiting in any way to the shape or configuration of the movable component that can interface and engage with the stationary bearing housing 122. Thus, shapes other than "blocks" could be formed and achieve the same function and result, such as a spherically shaped movable component that interfaces with a corresponding spherical surface of the stationary bearing housing 122, for instance.

In one example, the locking block assembly 120*a* can comprise a pair of elastic components 170*a* and 170*b* configured to automatically bias (i.e., apply a force, such as a spring force, to and in the direction of) the movable block 162*a* in the locked position. More specifically, and with further reference to FIGS. 7A and 7B, each elastic component 170*a* and 170*b* can comprise a spring, such as a coil or other type of spring, seated at one end against a back plate 160, and seated at the other end in respective openings 172*a* and 172*b* formed through the movable block 162*a*. The back plate 160 can be interfaced and coupled to the housing support member 158*a* via a coupling device 173 fastened to both of the back plate 160 and to the housing support member 158*a*. In the locked position of FIG. 7A, the elastic components 170*a* and 170*b* are in an expanded state that automatically exerts a biasing spring force against the moveable block 162*a* away from the housing support member 158*a* and inwardly toward the perimeter channel 156, therefore seating the movable block 162*a* into the perimeter channel 156 between the annular flange portion 168 and the shoulder portion 183 of the bearing housing 122 to lock the bearing assembly 102 to the housing 110 (see also FIGS. 1 and 5). Thus, the elastic components 170*a* and 170*b* can be installed in a pre-loaded state, such that they are configured to exert a force on or push the movable block 162*a* in a direction so as to place the bearing assembly 102 in the locked position. Those skilled in the art will recognize that the elastic components can be any elastic component or element that acts in a spring-like manner, namely one that can be pre-loaded and caused to apply or exert a biasing force on the moveable block 162*a*. Example elastic components can include, but are not limited to, an elastic polymer, a compressed gas component, or a variety of other spring-like elements. In some examples, only one elastic component may be incorporated to perform the function of biasing the movable block 162*a* in the locked position. Again, although not discussed in detail, the same arrangement and interface with the bearing assembly can be provided for with respect to each of the other locking block assemblies.

Regarding transitioning or moving from the locked position (FIG. 7A) to the unlocked position (FIG. 7B), in one example the lower locking block assembly 120*a* can comprise a valve device 174 coupled to the coupling device 173 (and the back plate 160) via fasteners 176 (one labeled). The valve device 174 can be a cylindrical one-way or single acting valve device, and can comprise a hydraulic or pneumatic type of valve device. In the specific example shown, which is not intended to be limiting in any way, the valve device 174 can comprise a head 178 that is received through a first opening 180*a* of the movable block 162*a*. The valve device 174 can further comprise a body section 182 extending from the head portion 178. The body section 182 can be received through a second opening 180*b* of the movable block 162*a*. The second opening 180*b* can be sized slightly smaller in diameter than the first opening 180*a* so that the valve device 174 is slidably received through the first and second openings 180*a* and 180*b*, as shown when comparing FIGS. 7A and 7B.

The body section 182 of the valve device 174 can comprise a fluid port 186 and a first fluid conduit 188*a* in fluid communication with each other. The first fluid conduit 188*a* can be a linear fluid opening in fluid communication with second and third conduits 188*b* and 188*c* that each extends orthogonal from the first fluid conduit 188*a*, as formed through the head portion 178. The second and third conduits 188*b* and 188*c* are in fluid communication with a fluid pressure chamber 191 defined by the first opening 180*a* and the valve device 174. Thus, the head portion 178 is positioned slightly laterally offset from an end of the first opening 180*a* (FIG. 7A) to accommodate fluid communication between the transverse conduits 188*b* and 188*c* and the fluid pressure chamber 191 adjacent an inside surface of the head portion 178 (and when in the locked position). This allows for the fluid pressure chamber 191 to be filled with a fluid (liquid or gas) via the conduits 188*a-c* of the valve device 174.

Accordingly, a fluid (hydraulic or pneumatic) system 194 (schematically shown) can be operatively coupled to the lower locking block assembly 120*a*, wherein the hydraulic system 194 can comprise a fluid line 196 in fluid communication with the fluid port 186. Thus, when the lower locking block assembly 120*a* is in the locked position of FIG. 7A, the fluid system 194 is operable to actuate the movable block 162*a* to the unlocked position of FIG. 7B, upon supplying fluid pressure to the fluid pressure chamber 191 via the fluid port 186. That is, when fluid pressure is supplied to the fluid port 186, fluid traverses through the first conduit 188*a*, and then through the second and third conduits 188*b* and 188*c*, and ultimately to the fluid pressure chamber 191. The volume of the fluid pressure chamber 191 increases as fluid pressure is supplied thereto, which causes the movable block 162*a* to be drawn (to the right) toward the back plate 160 (FIG. 7B), thereby causing compression of the elastic components 170*a* and 170*b*. In this manner, the fluid system 194 is operable to selectively maintain the movable blocks 162*a-c* in the unlocked position by maintaining application of an actuation force (e.g., the supply of fluid pressure) to the moveable blocks 162*a-c* to be in the unlocked position. This allows for insertion of the bearing assembly 102 into the housing 110 (or removal therefrom) by a top drive assembly (or other means) because the stationary bearing housing 122 is uncoupled and free from being locked or fixed to the RCD housing 110 by the lower locking block assemblies 120*a-c*.

As can be appreciated, such actuation force applied by the fluid system 194 to move the movable block 162*a*, for instance, to the unlocked position is greater than the spring force exerted by the elastic components 170*a* and 170*b* (that maintains the movable block 162*a* in the locked position). Due to this actuation force, the movable block 162*a* may effectively move to the unlocked position of FIG. 7B upon supplying sufficient fluid pressure to overcome the spring force being applied by the elastic components 170*a* and 170*b*. The fluid system 194 can comprise a number of hydraulic or pneumatic valves, pumps, motors, controllers, etc., known in the art to supply and remove fluid pressure to a one-way valve, and can be operated manually or automatically by a computer system operable to control the fluid system 194 by known means of controlling fluid pumps and motors.

In this system, the movable block 162*a* can automatically transition from the unlocked position (FIG. 7B) to the locked position (FIG. 7A), by removing the aforementioned fluid pressure, by virtue of the biasing force of the elastic components 170*a* and 170*b*. This means that the potential energy that is stored by the elastic components 170*a* and 170*b* can be released (when transitioning from the unlocked to locked position), upon removing fluid pressure (i.e., removing the actuation force) via the fluid system 194. This allows the elastic components 170*a* and 170*b* to expand, thereby automatically moving the movable block 162*a* to the locked position of FIG. 7A. Thus, there is no active actuation or external control of the movable block 162*a* to cause it to move to the locked position. Indeed, it is the stored spring force that passively, and automatically, actuates the movable block 162*a* to the locked position.

Advantageously, this system provides a fail-safe device to help prevent injury to operators working around the RCD 100 because the locking block assemblies 120*a-c* are caused to be in a locked position by default, and to automatically self-lock to the bearing assembly 102 upon removing fluid pressure from the movable blocks 120*a-c*. For example, if fluid pressure is lost due to failure of the hydraulic system for some reason, the locking block assemblies 120*a-c* will automatically move to the locked position via the aforementioned stored spring force. This can ensure that the bearing assembly 102 is not blown out upwardly by wellbore fluid pressure during drilling in instances where the system fails or loses pressure, which can potentially be catastrophic to the system and human operators. Moreover, there is no requirement for a human operator to manually interact with or engage the bearing assembly 102 to lock it to the RCD housing 110, which improves safety and efficiency of the system because it prevents possible injury while automating the locking function, in contrast with prior systems that are manually operated (e.g., with rams, clamps, etc.), and/or that require the system to perform an active actuation function to lock the bearing assembly.

Such "automatic" locking movement to the locked position also assists to properly align the bearing assembly 102 with the RCD housing 110, which is important for proper downhole drilling and to prolong the life of the bearing assembly 102. This is because, with prior current or existing technologies that rely on active actuation to lock a bearing assembly to an RCD housing (e.g., ram locks controlled by electric or hydraulic motors), precisely controlling the travel and position of such ram locks relative to each other is difficult and problematic because, in many instances, one of the ram locks may move too quickly (and/or its starting position may be unknown), thereby contacting the bearing assembly before the other ram locks happen to contact the bearing assembly. This often misaligns the bearing assembly relative to the RCD housing (i.e., the central axis of the wellhead and RCD housing may be not-collinear with the rotational axis of the bearing assembly). This can cause the bearing assembly to rotate off-axis relative to the central axis of the RCD housing, which can cause the bearings and sealing elements to wear down more rapidly. This can also damage components of the overall system in instances where the ram locks are in different lateral positions around the bearing assembly, or even cause mud/debris to enter into and through the bearing assembly.

However, with the present technology disclosed herein, the (expanding) the locking block assemblies 120*a-c*, including the respective moveable blocks 162*a-c* and the elastic components (e.g., 170*a* and 170*b*) associated with each movable block 162*a-c*, when transitioning to the locked position, are configured to and tend to compensate for possible misalignment. For example, if the movable block 162*a* first contacts the stationary bearing assembly 122 before the other movable blocks 162*b* and 162*c* happen to contact the stationary bearing assembly 122, the elastic components 170*a* and 170*b* of the movable block 162*a* may slightly compress to accommodate for the pressure applied by the other movable blocks 162*b* and/or 162*c* when they (eventually) contact the stationary bearing housing 122. Thus, the bearing assembly 102 tends to float about the housing 110 when the movable blocks 162*a-c* transition from the unlocked position to the locked position, so that the bearing assembly 102 is allowed to self-align with the RCD housing 110 in lateral directions. The strategic positioning of the locking block assemblies 120*a-c* relative to one another can also assist in helping the system to self-align (e.g., the locking block assemblies being spaced a strategic distance from one another). In this manner, the elastic component(s) of each of the movable blocks 162*a-c* may be identical or substantially the same (e.g., have the same spring constant, material, pre-load position, length, and other properties). Therefore, an equal or substantially equal amount of biasing spring force may be exerted by each of the lower locking block assemblies 120*a-c*. This can help to ensure that there is an equal amount of force being exerted against and around the bearing assembly 102 to maintain it in the locked position. However, some differences in the amounts of applied force from each of the locking block assemblies 120*a-c* can be possible and accounted for, such as may be the case if the bearing assembly 102 is not precisely aligned with the RCD housing 110.

This "floating" functionality can also be advantageous during drilling operations and while components of the bearing assembly 102 rotate. For example, if the bearing assembly 102 happens to slightly move laterally relative to the housing 110 along the x axis and/or y axis, the elastic components of one or more locking block assemblies can slightly compress (or expand as the case may be) due to said slight lateral movement of the bearing assembly 102. This assists to continuously align the bearing assembly 102, in real-time during drilling, relative to the housing 110 to facilitate lateral movement of the bearing assembly 102 in at least one translational degree of freedom (x and/or y translational axes). Therefore, the bearing assembly 102 can be maintained in a constant aligned position relative to the housing 110. This can further prolong the life of components of the system, such as the upper and lower sealing elements 152 and 134, and the tapered bearings 126*a* and 126*b*, because an axis of rotation Y of the bearing assembly 102 can be substantially or completely aligned with a vertical centerline C of the RCD housing 110.

As can be appreciated by the view of FIG. 5, each movable block 162*a-c* has a respective axis of translation X1, X2, and X3 when moved between the locked and unlocked positions. Thus, axis of translation X1 is generally orthogonal to axis of translation X3, which is generally orthogonal to axis of translation X2. Accordingly, axes of translation X1 and X2 are generally collinear with each other. In this manner, the three locking block assemblies 120*a-c* can be positioned to surround the stationary bearing housing 122 at respective 90 degree positions around 270 degrees of the circumference of the stationary bearing housing 122, as shown on FIG. 5, for instance. This particular configuration and assembly is not intended to be limiting in any way as those skilled in the art will recognize that, in one aspect, only two opposing locking block assemblies can be included, or in another aspect, that four or more locking block assemblies can be included, which are positioned annularly around the bearing assembly 102.

Figure 8A:
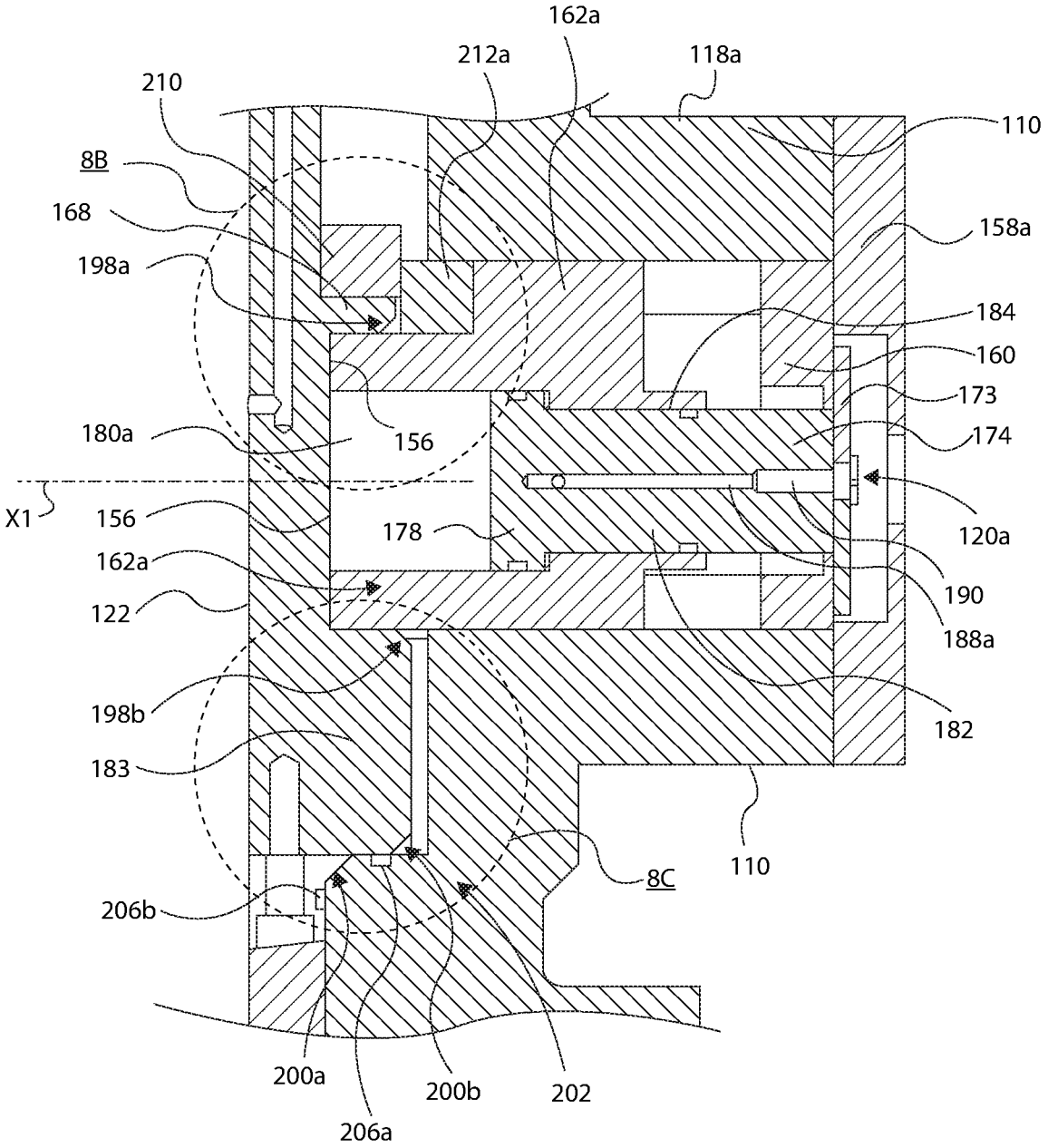
FIG. 8A is a partial cross-sectional view of the RCD housing and bearing assembly of FIG. 1, taken along lines 8A of FIG. 2, and showing the locking block assembly in a nominally locked position with the bearing assembly.
Figure 8B:
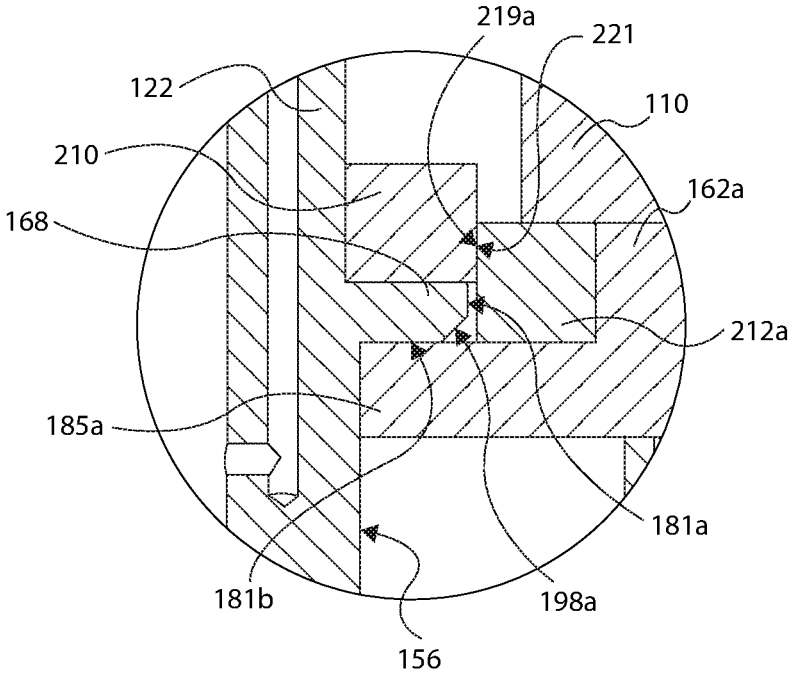
FIG. 8B is a close-up or detailed view of the portion of the bearing assembly identified as 8B in FIG. 8A.
Figure 8C:
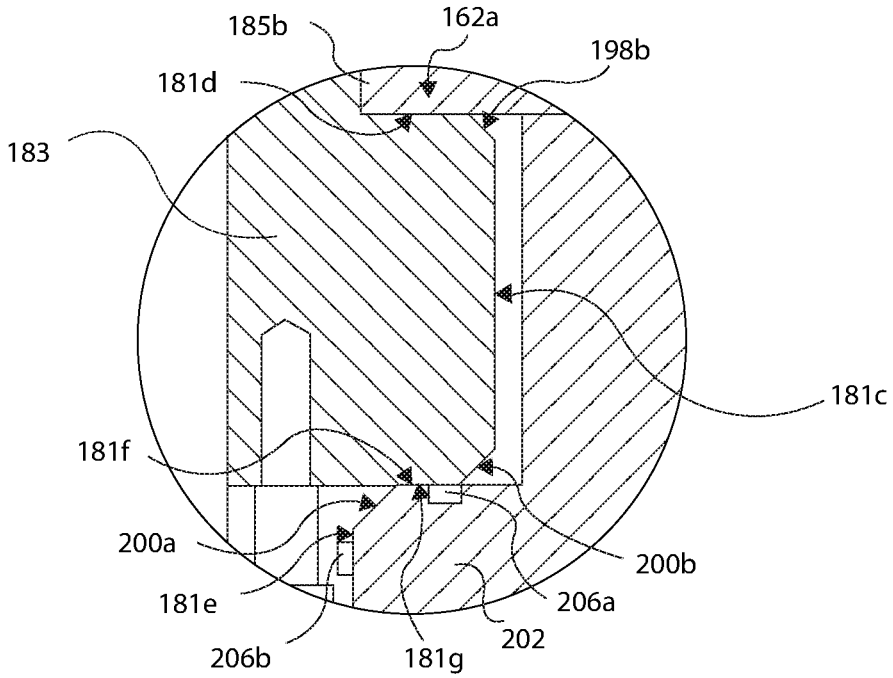
FIG. 8C is a close-up of detailed view of the portion of the bearing assembly identified as 8C in FIG. 8A.

With further reference to FIGS. 8A-8C, the locking block assemblies 120*a-c* can be configured to collectively self-align the bearing assembly 102 to the housing 110 when transitioning from the unlocked position to the locked position. This can be accomplished by forming upper and lower transition surfaces (e.g., upper and lower chamfers 198*a* and 198*b*) radially around the stationary bearing housing 122 adjacent the perimeter channel 156. Specifically, the annular flange member 168 (of the stationary bearing housing 122) comprises an outer radial perimeter surface 181*a* formed vertically about a plane orthogonal to a lower interface surface 181*b* of the annular flange member 168. The transition surface, in this example upper chamfer 198*a*, extends between the radial perimeter surface 181*a* and the interface surface 181*b*, and all the way around the perimeter of the annular flange member 168. Similarly, the stationary bearing housing 122 comprises a shoulder portion 183 extending outwardly from the perimeter channel 156, which shoulder portion 183 comprises a radial perimeter surface 181*c* formed vertically about a plane orthogonal to opposing surfaces 181*d* and 181*g*. A transition surface can also be formed between these surfaces. In the example shown, a lower chamfer 198*b* extends between the lower radial perimeter surface 181*c* and the lower surface 181*d*, and all the way around the perimeter of the annular shoulder portion 183. Therefore, when the movable block 162*a* is moved from the unlocked position (FIG. 7B) to the locked position (FIGS. 8A-8C), the upper and lower chamfers 198*a* and 198*b* assist to axially or vertically self-align the stationary bearing housing 122. This is because upper and lower corner areas 185*a* and/or 185*b* of the movable block 162*a* may slide along respective upper and lower chamfers 198*a* and/or 198*b*, which may cause the bearing assembly 102 to move vertically upwardly or downwardly (as the case may be), until each movable block 162*a-c* is properly, vertically aligned with the perimeter channel 156 of the stationary bearing housing 122 so that the movable blocks 162*a-c* may properly/fully interface with the perimeter channel 156. Without such upper and lower chamfers 198*a* and 198*b*, the movable blocks 162*a-c* may jam or bind-up against the stationary bearing housing 122, thereby not properly seating into the perimeter channel 156.

Similarly, the housing 110 itself can also comprise a transition surface, such as a chamfer (e.g., chamber 200*a*) formed annularly adjacent a shoulder portion 202 of the housing 110, as shown in FIGS. 8A and 8C. In this example, the shoulder portion 202 comprises a radial perimeter surface 181*e* formed vertically and orthogonal to a surface 181*f*, and the chamfer 200*a* extends between the radial perimeter surface 181*e* and the surface 181*f*. And similarly, the stationary bearing housing 122 can also comprise a transition surface, such as a chamfer (e.g., chamfer 200*b*) formed annularly adjacent a lower area of the annular shoulder portion 183 of the stationary bearing housing 122. Thus, a surface 181*g* can be formed orthogonal to the radial perimeter surface 181*c*, and the chamfer 200*b* can extend therebetween. The surface 181*g* of the annular shoulder portion 183 can be seated against the surface 181*f* of shoulder portion 202 when the bearing assembly 102 is inserted into the housing 110, and the chamfers 200*a* and 200*b* can assist in self-alignment of the bearing assembly 102 to the housing 110. That is, the chamfers 200*a* and 200*b* may slide along each other during insertion of the bearing assembly 102 into the housing 110 (if the bearing assembly 102 is laterally and/or vertically misaligned) to facilitate said self-alignment, which is particularly important during the transition between the unlocked position to the locked position so that the stationary bearing housing 122 does not get jammed or bind-up when seated into the housing 110.

These self-alignment features can be advantageous in the face of several potential operational situations. For example, the housing 110 may not always be properly vertically disposed as extending from the borehole (e.g., relative to Earth and gravity). Moreover, the bearing assembly 102 may not always be properly aligned with the housing 110 while the bearing assembly 102 is being inserted into the housing 110 via a top drive assembly. Still further, a large amount of spring force can be exerting against each movable block (e.g., 500 pounds or more for each elastic component), causing the movable blocks to bind-up or jam against the stationary bearing housing 122 when moving to the locked position. Thus, to account for these considerations, and to properly align and lock the bearing assembly 102 to the housing 110, the chamfers 200*a* and 200*b* are formed, as described above, to help self-align the bearing assembly 102 to the housing 110 when being inserted into the housing 110. Similarly, the chamfers 198*a* and 198*b* are formed, as described above, to vertically guide and self-align the movable blocks 162*a-c* when transitioning from the unlocked position to the locked position to the stationary bearing housing 122, in case the bearing assembly 102 is not properly vertically aligned with the housing 110.

On either side of chamfer 200*a* of the housing 110, a pair of seals 206*a* and 206*b* may be disposed to prevent mud and other debris from entering areas of the bearing assembly 102.

Figure 9:
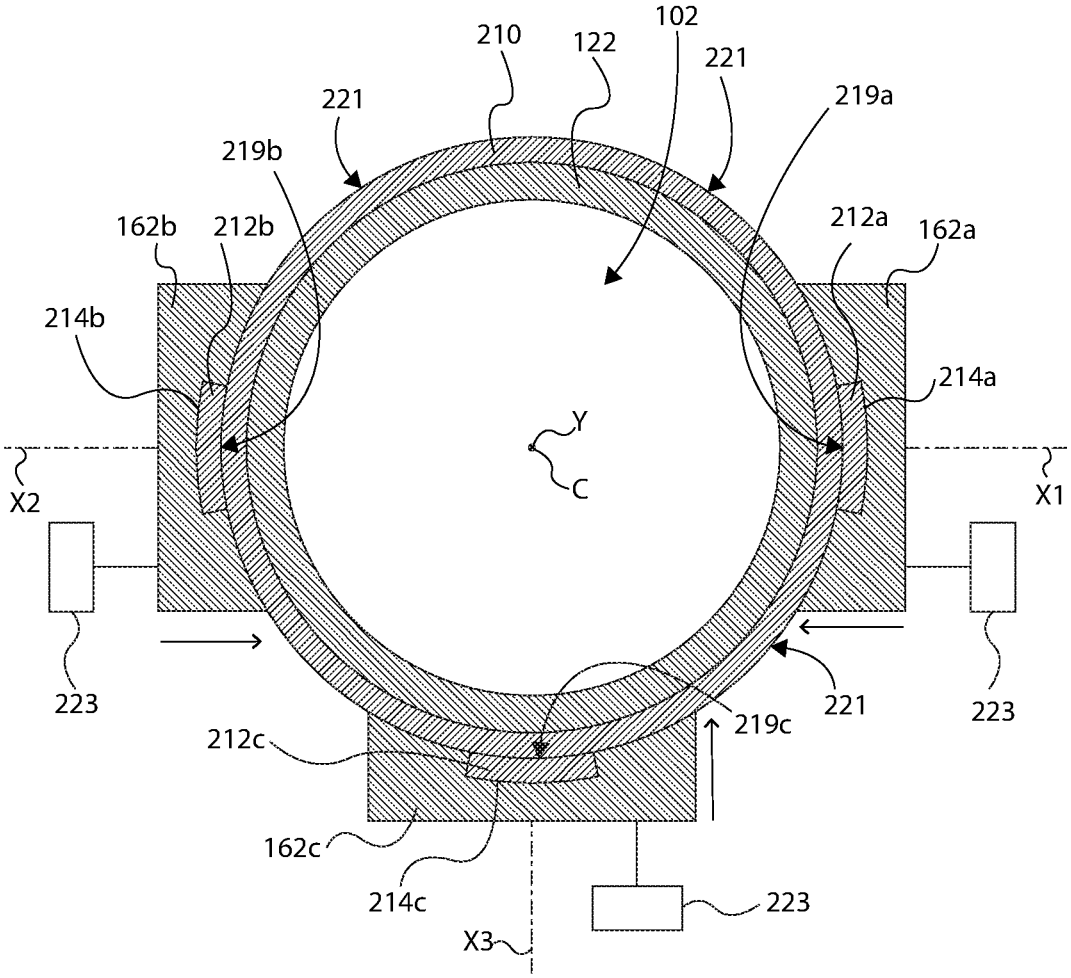
FIG. 9 is a cross-sectional view of the bearing assembly and the locking block system of FIG. 1, taken along lines 9-9 of FIG. 5.

With further reference to FIG. 9, illustrated is an anti-rotation locking system for restricting rotation of the stationary bearing housing 122 of the bearing assembly 102 relative to the housing 110 during a drilling operation. Note that FIG. 9 is a lateral cross-sectional view of certain components of FIG. 5, as will be appreciated from the below description.

As discussed above, as the pipe 108 is rotated, the rotary bearing casing 124, the sealing element 134, and the upper sealing assembly 109*a* concurrently rotate about the axis of rotation Y. Such rotational movement generates inertia, which exerts a rotational inertia force to the stationary bearing housing 122 via the tapered bearing assemblies 126*a* and 126*b*. Such inertial force is undesirable because the stationary bearing housing 122 must not rotate and should be locked to the RCD housing 110 to prevent wear or damage on components associated with the RCD 100 and its bearing assembly 102.

Therefore, in one example (e.g., as shown in FIGS. 5, 6, 8A-8C, and 9), the anti-rotation locking system can comprise a locking ring 210 associated with or situated about (e.g., coupled to) the stationary bearing housing 122, and a plurality of movable anti-rotation devices 212*a-c* operable between a locked position and an unlocked position. Each movable anti-rotation device 212*a-c* is operable to engage or interface with the locking ring 210 when in the locked position to lock the stationary bearing housing 122 to the RCD housing 110 independent of the rotational position of the stationary bearing housing 122 relative to the RCD housing 110 (while the bearing assembly 102 is being inserted into and locked to the RCD housing 110). Note that the bearing assembly 102 is labeled in an empty space for purposes of illustration clarity, but it should be appreciated that is can/would contain the components shown in FIGS. 1-8C.

More specifically, each movable block 162*a-c* can support respective anti-rotation devices 212*a-c* about insert portions 214*a-c* of each movable block 162*a-c*, as shown in FIG. 9. The insert portions 214*a-c* can be formed about a central outer portion of the respective movable blocks 162*a-c*, and can be sized to receive and retain the respective movable anti-rotation devices 212*a-c*. The insert portions 214*a-c* can each have a designed cross-sectional area that corresponds to a similar or matching shape of the respective anti-rotation devices 212*a-c*. In the example shown, the insert portions 214*a-c* and the anti-rotation devices 212*a-c* comprise a trapezoidal shape or configuration. The anti-rotation devices 212*a-c* can be press fit, welded, adhered, or otherwise coupled to the respective movable blocks 162*a-c*. In another example, each movable block 162*a-c* can support a plurality of anti-rotation devices along an outer edge of the movable block 162*a*, for instance, adjacent the shoulder portion 166 (FIG. 6). As such, the single anti-rotation device shown associated with each respective movable block is not intended to be limiting in any way.

Accordingly, each movable anti-rotation device 212*a-c* moves along with the respective movable blocks 162*a-c* between the locked and unlocked positions, as detailed above regarding FIGS. 1-8C. As shown with the example movable block 162*a* in FIG. 6, the shoulder portion 166 can comprise a first interface surface 216 sized and configured to interface with the lower interface surface 181*b* of the annular flange member 168 (see FIG. 8B). The shoulder portion 166 can comprise a second interface surface 218 extending upward (e.g., in an orthogonal direction) from the first interface surface 216 and positioned adjacent the radial surface 181*a* of the annular flange member 168 when in the locked position (FIG. 8B).

Each movable anti-rotation device 212*a-c* and the locking ring 210 can define a frictional anti-rotation locking system. Specifically, in this example the locking ring 210 includes a first frictional surface 221 (i.e., an outer perimeter surface), and each movable anti-rotation device 212*a-c* includes a frictional surface 219*a-c* (i.e., an outer surface facing the first frictional surface 221)(see FIG. 8B). Thus, the frictional surfaces 219*a-c* are each configured to interface with a portion of the first frictional surface 221 of the locking ring 210, when in the locked position (FIGS. 9 and 8B), to restrict rotation of the stationary bearing housing 122 relative to the RCD housing 110.

In one example, the frictional surfaces 219*a-c* can each comprises a brake pad surface, such as those formed of synthetic composites, semi-metallic materials, metallic materials, ceramic materials and others as will be apparent to those skilled in the art. The second frictional surfaces 219*a-c* can be configure to comprise a suitable coefficient of friction (e.g., from 0.35 to 0.42 (or it can vary from such range)). Accordingly, the locking ring 210 can be comprised of composite, ceramic, metal, or other suitable material(s), the locking ring 210 also comprising a thin layer or surface of similar brake pad material, such that the first frictional surface 221 operates or functions to provide a suitable coefficient of friction to prevent relative rotation between the stationary bearing housing 122 and the RCD housing 110 upon interfacing and interacting with the frictional surfaces 219*a-c* when in the locked position. In this manner, a collective frictional force between the movable anti-rotation devices 212*a-c* and the locking ring 210 can be configured to be greater than an inertia force exerted on the stationary bearing housing 122 upon rotation of the pipe 108 and the rotating components of the bearing assembly 102. Therefore, the stationary bearing housing 122 is restricted from rotation relative to the RCD housing 110 upon moving the movable blocks 162*a-c*, and the anti-rotation devices 212*a-b*, to the locked position, such that a collective frictional force is generated between the locking ring 210 and the movable anti-rotation devices 212*a-c*.

In one example, the movable blocks 162*a-c* can be moved upon the release of potential energy by their respective elastic components (e.g., elastic components 170*a* and 170*b*), as discussed above. The spring force exerted by each elastic component can be about as needed. For example, in some cases, the elastic component(s) can be configured to exert between 400 and 600 pounds, although this is not intended to be limiting in any way. This spring force biases the respective movable blocks 162*a-c* inwardly toward the locking ring 210 until each movable anti-rotation device 212*a-c* contacts and frictionally engages with the locking ring 210, as described above. Then, upon supplying fluid pressure to the movable blocks 162*a-c*, the anti-rotation devices 212*a-c* are disengaged from or moved away from the locking ring 210, thereby removing the friction force. Some examples of means of actuation of the movable blocks 162*a-c* is described above.

Alternatively, an actuation system 223 can be coupled to all of the movable blocks 162*a-c* to actively actuate the movable blocks 162*a-c* between unlocked and locked positions along their respective axes of translation X1, X2, and X3. The actuation system 223 can comprise a hydraulic actuator, an electric actuator, a pneumatic actuator, and/or other actuator configured to effectuate translational movement of the movable blocks 162*a-c* along their respective axes of translation between the locked and unlocked positions. In other words, the elastic components and valve devices described above (with reference to FIG. 7A) are not the only ways to operate the frictional anti-rotation locking system described herein. Indeed, other actuation systems are contemplated herein, which could be used to actuate the movable blocks 162*a*-c between the locked and unlocked positions.

Regardless of the means of actuating the movable blocks 162*a-c*, the stationary bearing housing 122 can be locked to the RCD housing 110 independent of the rotational position of the stationary bearing housing 122 relative to the RCD housing 110. That is, when the bearing assembly 102 is inserted into the RCD housing 110, the rotational position of the stationary bearing housing 122 may be unknown and/or dynamically changing because the top drive assembly merely picks up and inserts the bearing assembly 102 into the RCD housing 110 without regard to, or exact control over, the rotational position of the stationary bearing housing 122. However, with the present example of the frictional anti-rotation locking system, the rotational position of the stationary bearing housing 122 is less relevant because the entire outer perimeter surface of the locking ring 210 is a frictional surface (i.e., the first frictional surface) that can be engaged by the movable anti-rotation devices 212*a-c* when moved to the locked position. Thus, the rotational position of the stationary bearing housing 122 is independent of the position of the movable anti-rotation devices 212*a-c* (and the housing 110) because the movable anti-rotation devices 212*a-c* can contact any surface portion of the first frictional surface 221 of the locking ring 210 (collectively and automatically) despite the position of the stationary bearing housing 122 and the attached locking ring 210. Other systems require human interaction with the bearing assembly (i.e., grabbing/rotating) to clock or position a bearing assembly to a desired position before locking said bearing assembly to an RCD housing, which is time consuming and dangerous to the operators because their hands are prone to injury around the various moving parts associated with the RCD, its bearing assembly, and the top drive.

With continued reference to FIGS. 1-8C, FIGS. 10A-12 illustrate another example of an anti-rotation locking system for restricting rotation of a bearing assembly 302 (e.g., 102) relative to an RCD housing (e.g., 110) during a drilling operation. In this example, the anti-rotation locking system can comprise a locking ring 310 coupled to or otherwise secured to the stationary bearing housing 122, and a plurality of movable anti-rotation devices 312*a-c* operable between a locked position and an unlocked position, as detailed below. Each movable anti-rotation device 312*a-c* can be operable to engage the locking ring 310, when in the locked position, to lock the stationary bearing housing 122 of the bearing assembly 102 to the RCD housing 110 (FIG. 1) substantially independent of the rotational position of the stationary bearing housing 122 relative to the RCD housing 110.

More specifically, a plurality of locking block assemblies 320*a-c* (e.g., which are similar to locking block assemblies 120*a-c* discussed above) can comprise respective movable blocks 362*a-c* (e.g., similar to movable blocks 162*a-c* discussed above) that support respective movable anti-rotation devices 312*a-c* about insert portions of each movable block 362*a-c* (e.g., see insert portion 314*a* of movable block 162*a*). The insert portions can be formed about a central outer portion of the respective movable blocks 362*a-c*, and can be sized to receive and retain respective movable anti-rotation devices 312*a-c*.

Figure 11:
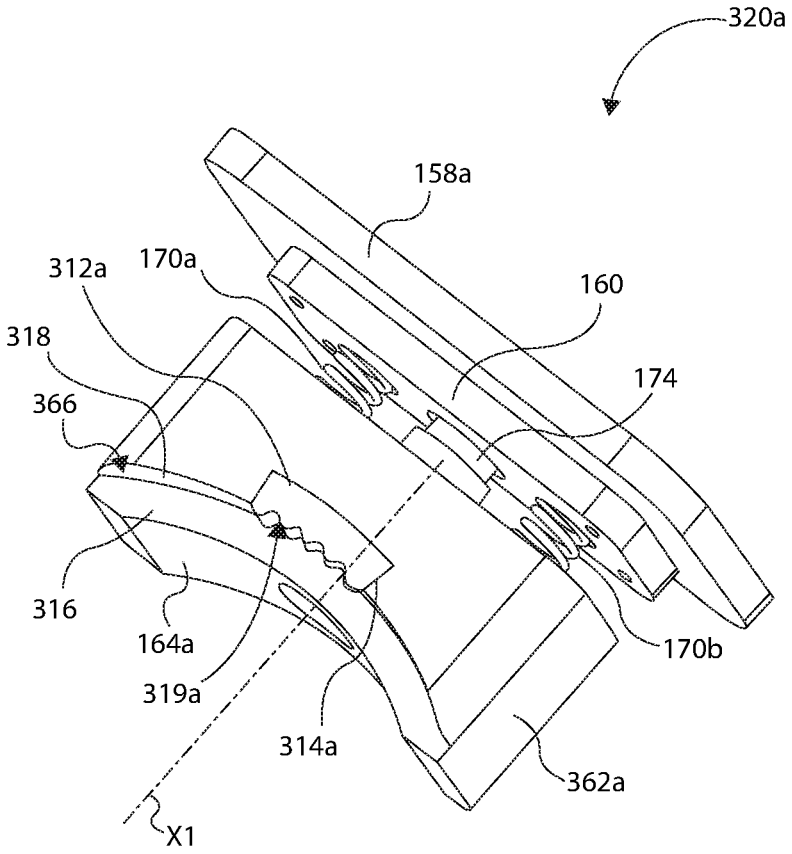
FIG. 11 is an isometric view of a movable block of a locking block assembly of the RCD of FIG. 1, comprising the anti-rotation locking system of FIG. 10A.

Each movable anti-rotation device 312*a-c* moves along with the respective movable block 362*a-c* between the locked and unlocked positions, as detailed above in one example regarding movable blocks 162*a-c*. As shown in FIG. 11, each movable block (as exemplified by movable block 362*a*) can have the same or similar features as the example movable blocks 162*a-c* discussed above. Thus, in the example of the movable block 362*a*, it can comprise a shoulder portion 366 comprising a first interface surface 316 interfaced to the lower interface surface 181*b* of the annular flange member 168 (e.g., FIG. 8B), and a second interface surface 318 extending from the first interface surface 316 and interfaced to the radial perimeter surface 181*a* of the annular flange member 168.

Each movable anti-rotation device 312*a-c* and the locking ring 310 can define a geared anti-rotation locking system. Specifically, the locking ring 310 can comprise geared teeth 321, and each movable anti-rotation device 312*a-c* can comprise respective locking geared teeth 319*a-c* formed therein and configured to engage with at least some of the geared teeth 321 of the locking ring 310 (such as with a gear/pinion interface). As shown, the individual teeth of the geared teeth 321 can be formed adjacent each other and around the entire perimeter of the locking ring 310. All the teeth associated with the geared anti-rotation locking system can comprise a suitable geared tooth geometry or nomenclature, such as spur gear teeth, Wildhaber-Novikov teeth, and other suitable geared configurations.

Figure 10B:
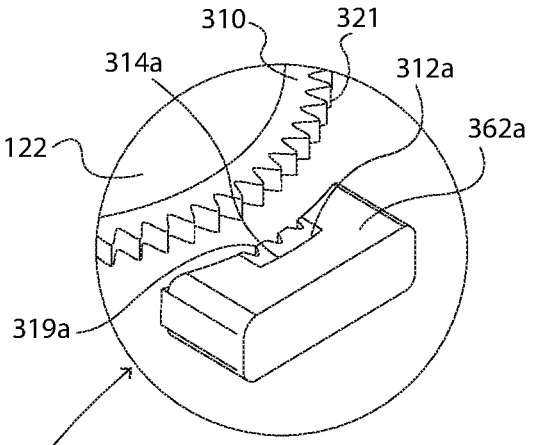
FIG. 10B is detailed view of the identified portion of FIG. 10A.
Figure 10A:
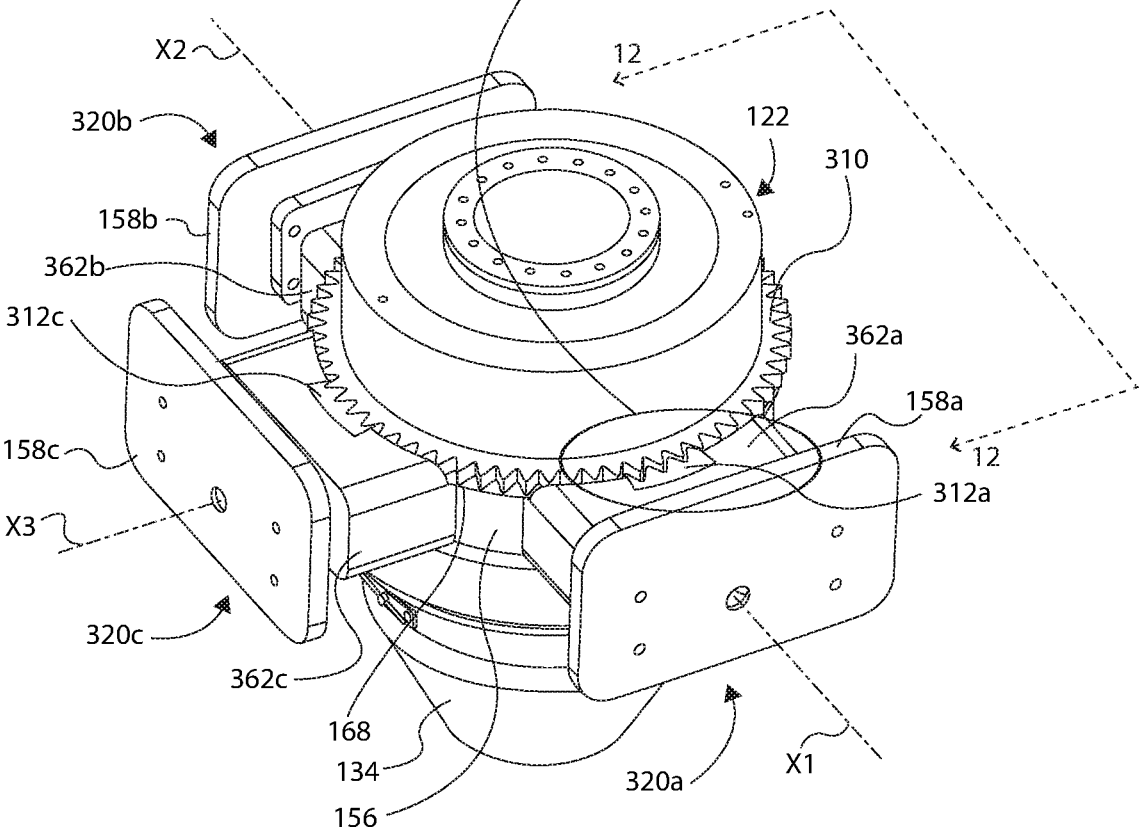
FIG. 10A is an isometric view of a portion of the bearing assembly and locking block system of FIG. 1, the locking block system comprising an anti-rotation locking system in accordance with another example.
Figure 12:
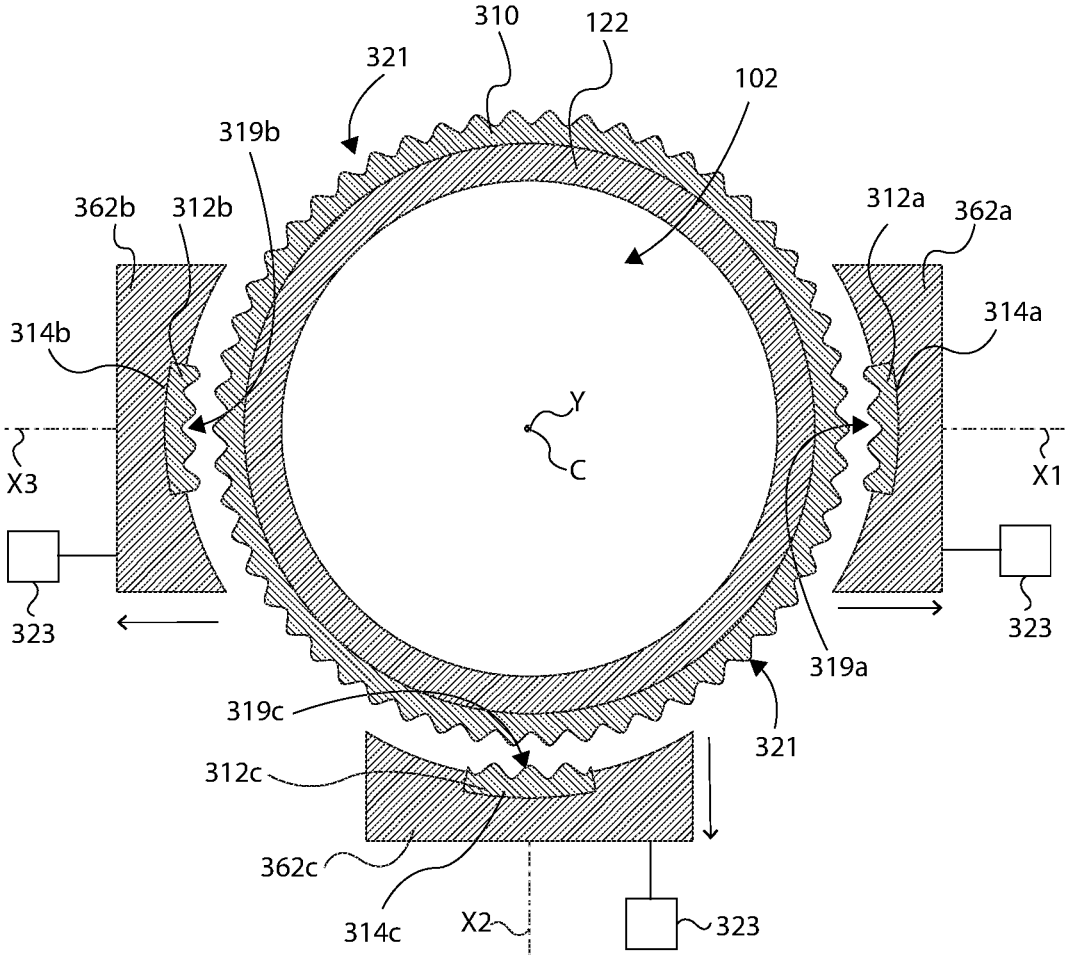
FIG. 12 is a cross-sectional view of certain components of the anti-rotation locking system of FIG. 10A taken along lines 12-12.

In this example, the teeth 319*a-c* of the anti-rotation devices 312*a-c* are configured to interface with the geared teeth 321 of the locking ring 310, when in the locked position (FIG. 10A), to restrict rotation of the stationary bearing housing 122 relative to the RCD housing 110. In this manner, a locking force between the movable anti-rotation devices 319*a-c* and the locking ring 310 is greater than a rotational inertia force exerted to the bearing assembly 102 upon rotation of the pipe 108 and the rotating components of the bearing assembly 102. Therefore, the stationary bearing housing 122 is restricted from rotation relative to the housing 110 upon movement of the movable blocks 362*a-c*, and the coupled movable anti-rotation devices 312*a-b*, to the locked position. Note that FIGS. 10B and 12 show unlocked positions for purposes of illustration, and FIG. 10B shows only a front-half portion of the movable block 362*a* for illustration.

In one example, the movable blocks 362*a-c* can be moved upon the release of potential energy by the elastic components 170*a* and 170*b*, as discussed above. Such spring force biases the respective movable blocks 362*a-c* inwardly toward the locking ring 310 until each movable anti-rotation device 312*a-c* contacts and engages with the locking ring 310. Then, upon supplying fluid pressure to the movable blocks 362*a-c* (e.g., as described above regarding 162*a-c*), the anti-rotation devices 312*a-c* are disengaged from or are moved away from the locking ring 310, thereby removing the locking force. Alternatively, an actuation system 323 can be coupled to each movable block 362*a-c* to actively actuate the movable blocks 362*a-c* between unlocked and locked positions, such as described regarding FIG. 9.

Advantageously, the stationary bearing housing 322 can be locked to the RCD housing 110 independent of the rotational position of the stationary bearing housing 122 relative to the RCD housing 110. That is, when the bearing assembly 102 is inserted into the RCD housing 110, the rotational position of the stationary bearing housing 122 may be unknown or variable because the top drive assembly merely picks up and inserts the bearing assembly 102 into the RCD housing 110 without regard to the rotational position of the stationary bearing housing 122. However, with the present example of the geared anti-rotation locking system, the rotational position of the stationary bearing housing 122 is less relevant because the entire perimeter of the locking ring 310 comprises geared teeth configured to engage with any of the teeth of each of the movable anti-rotation devices 312*a-c* when moved to the locked position. Thus, the rotational position of the stationary bearing housing 122 is independent of the position of the movable anti-rotation devices 312*a-c* and the housing 110 because the movable anti-rotation devices 312*a-c* can contact any portion of the locking ring 310 (collectively and automatically), despite the position of the stationary bearing housing 122 and the attached locking ring 310.

With continued reference to FIGS. 1-8C, FIGS. 13A-15 illustrate another example of an anti-rotation locking system for restricting rotation of the stationary bearing housing 122 of the bearing assembly 102 relative to the RCD housing 110 during a drilling operation. In this example, the anti-rotation locking system can comprise a locking ring 410 coupled or otherwise secured to the stationary bearing housing 122, and a plurality of movable anti-rotation devices 412*a-c* operable between a locked position and an unlocked position, as detailed below. Each movable anti-rotation device 412*a-c* is operable to engage the locking ring 410, when in the locked position, to lock the stationary bearing housing 122 to the RCD housing (e.g., 110) substantially independent of the rotational position of the stationary bearing housing 122 relative to the RCD housing 110.

More specifically, a plurality of locking block assemblies 420*a-c* (e.g., which are similar to locking block assemblies 120*a-c* discussed above) can comprise respective movable blocks 462*a-c* (e.g., similar to movable blocks 162*a-c*, also discussed above) that support respective movable anti-rotation devices 412*a-c* about insert portions of each movable block 462*a-c* (e.g., see insert portion 414*a* of movable block 162*a*). The insert portions 414*a-c* can be formed about a central outer portion of the respective movable blocks 462*a-c*, and can be sized to receive and retain respective movable anti-rotation devices 412*a-c*.

Figure 14:
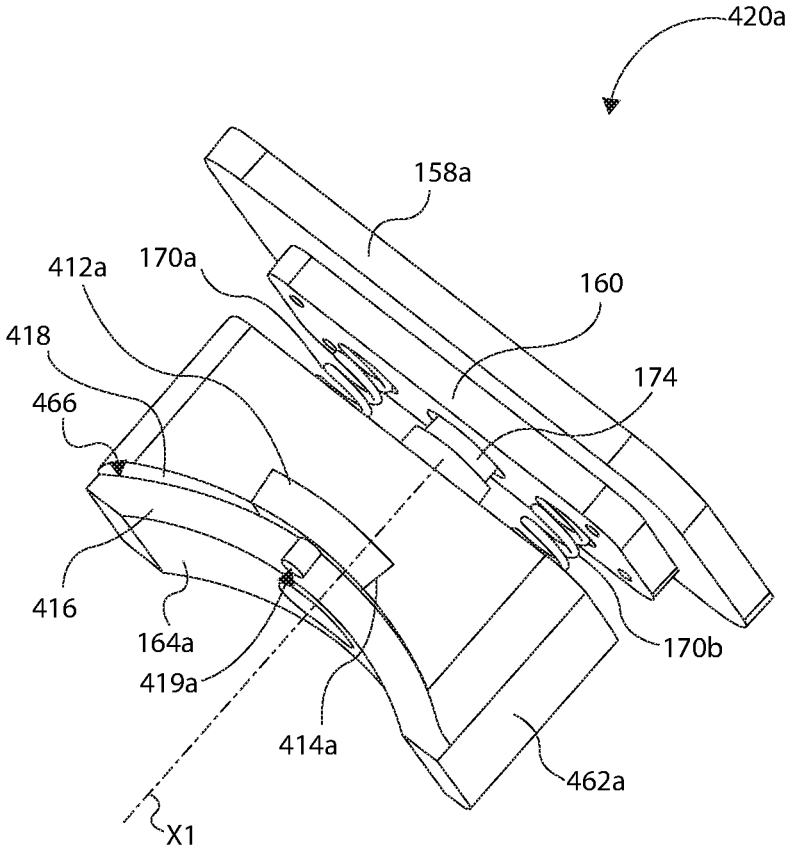
FIG. 14 is an isometric view of a movable block of a locking block assembly of the RCD of FIG. 1, comprising the anti-rotation locking system of FIG. 13A.

Each movable anti-rotation device 412*a-c* moves along with the supporting respective movable block 462*a-c* between the locked and unlocked positions, as detailed above in one example regarding movable blocks 162*a-c*. As shown in FIG. 14, each movable block (as exemplified by movable block 462*a*) can have the same or similar features as the example movable blocks 162*a-c* discussed above. Thus, in the example of movable block 462*a*, it can comprise a shoulder portion 466 comprising a first interface surface 416 interfaced to the lower interface surface 181*b* of the annular flange member 168 (e.g., FIG. 8B), and a second interface surface 418 extending from the first interface surface 216 and disposed adjacent to the first radial perimeter surface 181*a* of the annular flange member 168.

Each movable anti-rotation device 412*a-c* and the locking ring 410 can define a pinned anti-rotation locking system. Specifically, the locking ring 410 includes perimeter openings 421, and each movable anti-rotation device 412*a-c* includes a locking pin 419*a-c* sized to interface or engage with one opening of the perimeter openings 421 of the locking ring 410 when transitioning to the locked position. Each locking pin 419*a-c* can be a cylindrically shaped protrusion extending toward the locking ring 410, and each of the perimeter openings 421 can be a bore formed radially through and around the entire perimeter of the locking ring 410.

Figures 13A, 13B:
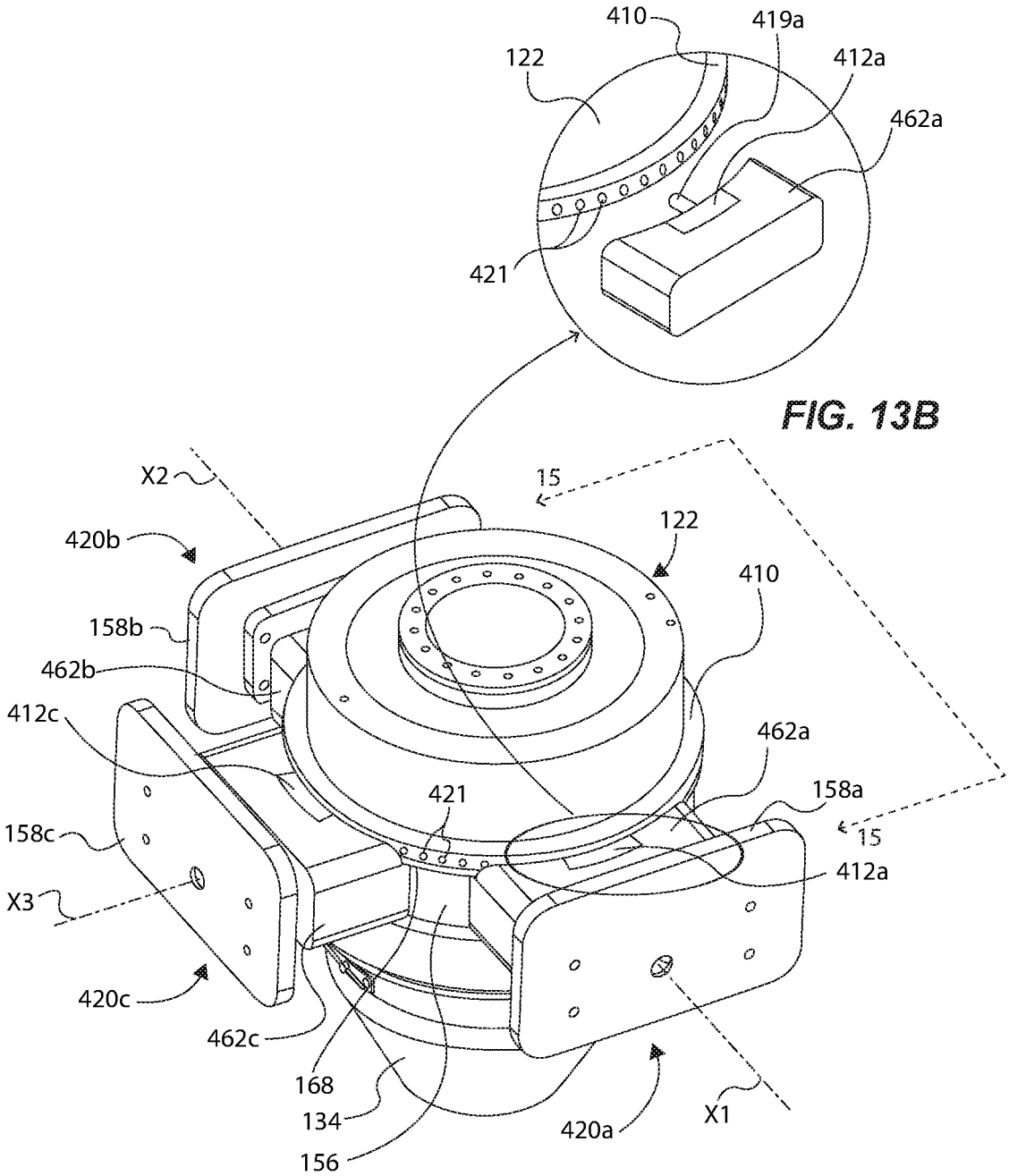
FIG. 13A is an isometric view of a portion of a bearing assembly, the locking block assembly comprising an anti-rotation locking system in accordance with another example.
FIG. 13B is detailed view of the identified portion of FIG. 13A.
Figure 15:
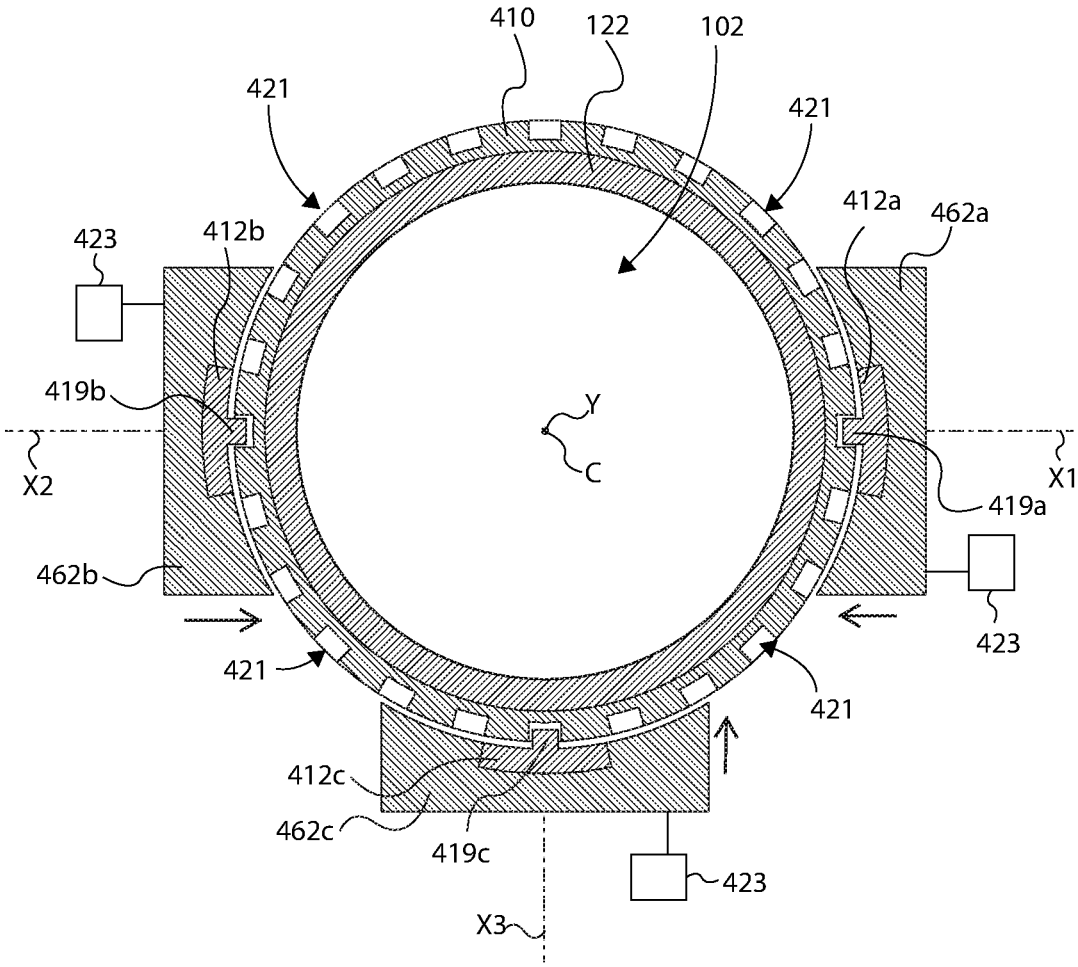
FIG. 15 is a cross-sectional view of certain components of the anti-rotation locking system FIG. 13A taken along lines 15-15.

The perimeter openings 421 can be sized slightly larger than the locking pins 419*a-c* to facilitate proper engagement, as shown in FIG. 15. Therefore, the locking pins 419*a-c* of each of the anti-rotation devices 412*a-c* are configured to interface with the openings of the perimeter openings 421 of the locking ring 410, when in the locked position, to restrict rotation of the stationary bearing housing 422 relative to the RCD housing 110. In this manner, a locking force between the movable anti-rotation devices 420*a-c* and the locking ring 410 is greater than a rotational inertia force exerted to the stationary bearing housing 122 upon rotation of the pipe 108 and the rotating components of the bearing assembly 102. Therefore, the stationary bearing housing 122 is restricted from rotation relative to the housing (e.g., 110) upon movement of the movable blocks 462*a-c*, and the coupled movable anti-rotation devices 412*a-b*, to the locked position. Note that FIG. 13B shows the unlocked position, and only a front-half portion of the movable block 462*a*, for purposes of illustration.

In one example, the movable blocks 462*a-c* can be moved upon the release of potential energy by the elastic components 170*a* and 170*b*, as discussed above. Such spring force biases the respective movable blocks 462*a-c* inwardly toward the locking ring 410 until each movable anti-rotation device 412*a-c* engages with the locking ring 410. Then, upon supplying fluid pressure to the movable blocks 462*a-c*, the anti-rotation devices 412*a-c* are moved away from the locking ring 410, thereby removing any locking force. Alternatively, an actuation system 423 can be coupled to each movable block 462*a-c* to actively actuate the movable blocks 462*a-c* between unlocked and locked positions, such as described regarding FIG. 9.

Advantageously, the stationary bearing housing 122 can be locked to the housing 110 independent of the rotational position of the stationary bearing housing 122 relative to the housing 110. That is, when the bearing assembly 102 is inserted into the housing 110, the rotational position of the stationary bearing housing 122 may be unknown or dynamically changing because the top drive assembly merely picks up and inserts the bearing assembly 102 into the housing 110 without regard to the rotational position of the stationary bearing housing 122. However, with the present example of the pinned anti-rotation locking system, the rotational position of the stationary bearing housing 122 is less relevant because the entire perimeter of the outer surface of the locking ring 410 comprises numerous openings each configured to be engaged by respective locking pins 419*a-c* of the movable anti-rotation devices 412*a-c* when moved to the locked position.

Thus, the rotational position of the stationary bearing housing 122 is substantially independent of the position of the movable anti-rotation devices 412*a-c* because their locking pins 419*a-c* can engage with any opening of the locking ring 410 (collectively and automatically), despite the position of the stationary bearing housing 122 and the attached locking ring 410. This is because the pipe 108 may be rotating the bearing assembly 102 as it is being inserted into the housing 110, so that the locking ring 410 and its perimeter openings 421 would be slowly rotating as the movable blocks 462*a-c* are moving to the locked position. In this manner, the pins 419*a-c* will eventually interface with and engage an opening of the perimeter openings 421.

In an alternative example, the perimeter openings described regarding FIG. 15 can instead be formed vertically from above (and around) the locking ring 410 (instead of being radially formed). Thus, one or more locking pins can be configured to vertically engage with said vertical perimeter openings when in the locked position. In this manner, a separate pin actuation mechanism can be coupled to the housing 110, which can be manually or automatically operated to vertically insert and remove the locking pins about the openings of said perimeter openings. In another aspect, a separate pin actuation linkage can be coupled to the moveable blocks such that, upon moving the movable blocks to the locked position, the vertically oriented pins automatically engage with an opening of the vertical perimeter openings of the locking ring.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A rotating control device (RCD) for use on a drill rig, the RCD comprising:

a housing operable with a blowout preventer;

a bearing assembly operable to be received in the housing, and operable to receive a pipe of a drill string; and a plurality of locking block assemblies supported by the housing, each locking block assembly comprising a movable block movable between an unlocked position that unlocks the bearing assembly from the housing, and a locked position that automatically locks the bearing assembly to the housing, each locking block assembly further comprising at least one elastic component configured to automatically bias the respective movable block towards the bearing assembly, wherein, with the plurality of locking block assemblies in the locked position, each respective at least one elastic component is at least partially compressed, such that the bearing assembly is caused to float relative to the housing.

2. The RCD of claim 1, wherein each movable block is configured to interface with a perimeter channel of a stationary bearing housing of the bearing assembly.

3. The RCD of claim 2, wherein each moveable block is biased in a nominally locked position.

4. The RCD of claim 3, wherein each locking block assembly comprises a valve device coupled to the housing, the movable block movably coupled to the valve device, whereby the movable block is actuatable to the unlocked position upon supplying fluid pressure to the valve device.

5. The RCD of claim 1, wherein the plurality of locking block assemblies comprise three locking block assemblies annularly spaced apart from one another to provide three points of contact with the bearing assembly.

6. The RCD of claim 1, wherein each locking block assembly comprises:

the movable block configured to interface with a perimeter channel of a stationary bearing housing of the bearing assembly when in the locked position; and a valve device coupled to the housing and movably interfaced with the movable block, wherein, upon supplying hydraulic fluid pressure via the valve device, the movable block moves to the unlocked position and the at least one elastic component compresses, and wherein, upon removing hydraulic fluid pressure via the valve device, the at least one elastic component expands to automatically lock the movable block to the perimeter channel of the stationary bearing housing.

7. The RCD of claim 6, wherein the movable block and the valve device define a fluid pressure chamber that retains pressurized fluid when the movable block is in the unlocked position.

8. The RCD of claim 7, wherein the valve device comprises a fluid input port fluidly coupleable to a hydraulic system, and at least one conduit in fluid communication with the fluid input port and the fluid pressure chamber.

9. The RCD of claim 1, wherein the locking block assemblies are configured to collectively self-align the bearing assembly relative to the housing when moved from the unlocked position to the locked position.

10. The RCD of claim 1, wherein each locking block assembly comprises the at least one elastic component of each of the locking block assemblies is configured to automatically bias the respective movable block in the locked position, such that each locking block assembly is configured to self-align the bearing assembly relative to the housing upon movement of the bearing assembly relative to the housing.

11. A rotating control device (RCD) for use on a drill rig, the RCD comprising:

an RCD housing coupled to a blowout preventer;

a bearing assembly received within the RCD housing and comprising a stationary bearing housing having a perimeter channel, the bearing assembly configured to receive and sealingly engage with a pipe of a drill string of a drill rig; and a plurality of locking block assemblies supported by the RCD housing, each locking block assembly comprising a movable block automatically biased in a locked position to engage the perimeter channel of the stationary bearing housing to lock the bearing assembly to the RCD housing, each locking block assembly further comprising at least one elastic component configured to automatically bias the respective moveable block towards the bearing assembly, wherein, with the plurality of locking block assemblies in the locked position, each respective at least one elastic component is at least partially compressed, such that the bearing assembly is caused to float relative to the RCD housing.

12. The RCD of claim 11, wherein the at least one elastic component is configured to automatically bias the movable block in the locked position.

13. The RCD of claim 12, wherein each locking block assembly comprises a valve device movably coupled to the movable block, the valve device configured to facilitate actuation of the moveable block to an unlocked position, thereby causing compression of the at least one elastic component, to facilitate removal of the bearing assembly from the RCD housing.

14. The RCD of claim 13, wherein the valve device comprises a hydraulic valve device, wherein the moveable block is actuated to the unlocked position by supplying hydraulic fluid pressure to the moveable block via the hydraulic valve device.

15. The RCD of claim 14, wherein, upon removing the hydraulic fluid pressure from the movable block via the hydraulic valve device, the movable block is caused to automatically move from the unlocked position to the locked position via a spring force exerted by the at least one elastic component.

16. The RCD of claim 11, wherein the stationary bearing housing comprises at least one chamfered surface adjacent the perimeter channel, so as to facilitate axial self-alignment between the movable block and the bearing assembly when the locking block assembly transitions from an unlocked position to the locked position.

17. The RCD of claim 12, wherein, when the locking block assembly transitions from an unlocked position to the locked position, the at least one elastic components bias the respective movable blocks toward the bearing assembly to facilitate lateral self-alignment of the bearing assembly relative to the RCD housing.

18. The RCD of claim 12, wherein the plurality of locking block assemblies comprises individual locking block assemblies positioned offset from one another about the RCD housing, each locking block assembly being configured, in the locked position, to facilitate lateral movement of the bearing assembly in at least one translational degree of freedom, such that the bearing assembly is maintained in a constant aligned position relative to the RCD housing.

19. The RCD of claim 11, further comprising an anti-rotation locking system configured to restrict rotational movement of the stationary bearing housing relative to the RCD housing when the movable blocks are in the locked position.

20. The RCD of claim 19, wherein the anti-rotation locking system comprises a locking ring coupled to the stationary bearing housing and a movable anti-rotation device coupled to each movable locking block, wherein each movable anti-rotation device is configured to engage with the locking ring, when the movable blocks are in the locked position, to restrict rotational movement of the stationary bearing housing.

21. The RCD of claim 20, wherein the locking ring comprises perimeter geared teeth, and each movable anti-rotation device comprises locking geared teeth configured to engage with at least some teeth of the perimeter geared teeth of the locking ring.

22. The RCD of claim 20, wherein the locking ring comprises a first frictional surface, and each movable anti-rotation device comprises a second frictional surface configured to engage with the first frictional surface of the locking ring.

23. A method for operating a rotating control device (RCD) of a drill rig, the method comprising:

identifying an RCD coupled to a blowout preventer of a drill rig, the RCD comprising:

an RCD housing operable with the blowout preventer;

a bearing assembly receivable into the RCD housing, the bearing assembly operable to receive a pipe of a drill string of the drill rig; and a plurality of locking block assemblies supported by the RCD housing, each locking block assembly having a movable block and at least one elastic component configured to automatically bias the respective movable block towards the bearing assembly;

applying an actuation force to the movable blocks of the plurality of locking block assemblies to be in an unlocked position, wherein each moveable block is caused to be displaced in a direction so as to compress the respective at least one elastic component;

selectively maintaining the movable blocks in the unlocked position by maintaining application of the actuation force on the moveable blocks;

inserting the bearing assembly into the RCD housing; and removing the actuation force, the movable blocks transitioning from the unlocked position to a locked position, wherein the moveable blocks interface with and engage the bearing assembly and each respective at least one elastic component is at least partially compressed, such that the bearing assembly is caused to float relative to the housing.

24. The method of claim 23, wherein removing the actuation force comprises removing fluid pressure from the movable blocks via a valve device to allow the respective at least one elastic component to cause the respective movable block to automatically move to the locked position.

25. The method of claim 24, wherein selectively maintaining the movable blocks in the unlocked position comprises maintaining the supply of fluid pressure to each movable block via the respective valve device.

26. The method of claim 24, further comprising facilitating lateral self-alignment of the bearing assembly relative to the RCD housing, the at least one elastic component of each of the locking block assemblies biasing the respective movable blocks relative to the bearing assembly as the locking block assemblies transition from the unlocked position to the locked position.

27. The method of claim 24, further comprising restricting rotation of the bearing assembly relative to the RCD housing independent of a rotational position of the bearing assembly relative to the RCD housing, wherein a locking ring is coupled to the stationary bearing housing, and a plurality of movable anti-rotation devices are each coupled to respective movable blocks, such that the movable anti-rotation devices engage with the locking ring upon the movable blocks transitioning from the unlocked position to the locked position.

* * * * *